US005224693A

United States Patent [19]

Taguchi et al.

[11] Patent Number: 5,224,693

[45] Date of Patent: Jul. 6, 1993

[54] MULTISTAGE PAPER FEEDING/CONVEYING APPARATUS AND METHOD THAT USES ELECTRO STATIC FORCES

[75] Inventors: Kazushige Taguchi, Warabi; Hiroshi Takahashi, Kawasaki; Kazunori Bannai, Tokyo; Tetsuya Fujioka; Fumio Kishi, both of Yokohama, all of Japan

[73] Assignee: Ricoh Company, Ltd., Tokyo, Japan

[21] Appl. No.: 793,939

[22] Filed: Oct. 22, 1991

[51] Int. Cl.[5] ..... B65H 3/18

[52] U.S. Cl. ..... 271/9; 271/10; 271/18.1; 271/270

[58] Field of Search ..... 271/9, 10, 18.1, 18.2, 271/34, 270, 275, 117, 118, 193

[56] References Cited

U.S. PATENT DOCUMENTS

| | | | |
|---|---|---|---|
| 3,726,520 | 4/1973 | Doi | 271/18.1 |
| 4,632,381 | 12/1986 | Cuir et al. | 271/270 |
| 4,770,403 | 9/1988 | Katsumata et al. | 271/9 |
| 4,864,461 | 9/1989 | Kasahara | 271/18.1 |
| 5;119,146 | 6/1992 | Nobumori | 271/270 |
| 5,121,170 | 6/1992 | Bannai et al. | 271/193 |

FOREIGN PATENT DOCUMENTS

| | | | |
|---|---|---|---|
| 40339 | 3/1985 | Japan | 271/9 |
| 197541 | 10/1985 | Japan | 271/9 |
| 209446 | 10/1985 | Japan | 271/9 |
| 223742 | 11/1985 | Japan | 271/9 |
| 257840 | 11/1986 | Japan | 271/9 |

*Primary Examiner*—D. Glenn Dayoan
*Assistant Examiner*—Steven M. Reiss
*Attorney, Agent, or Firm*—Oblon, Spivak, McClelland, Maier & Neustadt

[57] ABSTRACT

A multistage paper feeding/conveying apparatus has a plurality of recording paper storing devices vertically arranged at multiple stages; a paper feeder for feeding a sheet of recording paper one by one from arbitrary one of the recording paper storing devices; and a vertical conveyer vertically extending and opposed to a paper feeding side of each of the recording paper storing devices. The vertical conveyer conveys the sheet of recording paper fed from the paper feeder to a paper receiving section of an image forming apparatus. The paper feeder has a single paper feeding unit which can selectively come in contact with a front end portion of an uppermost sheet of recording paper on an upper face thereof with respect to sheets of recording paper stored within the plural recording paper storing devices. The paper feeding unit and the vertical conveyer have a single endless conveying belt and a device for forming an electric charge pattern for adsorbing the sheet of recording paper to the endless belt. A method for feeding the recording paper is also shown.

9 Claims, 18 Drawing Sheets

MULTISTAGE PAPER FEEDING/CONVEYING APPARATUS AND METHOD THAT USES ELECTRO STATIC FORCES

BACKGROUND OF THE INVENTION

1. Field of the Invention

The present invention relates to a paper feeding/conveying apparatus which is arranged on the lower side of an image forming apparatus, has paper feeding containers arranged at plural stages within a housing, raises sheets of paper fed from these paper feeding containers by a vertical conveying means and feeds the sheets of paper to the image forming apparatus. The present invention also relates to a method for feeding and conveying a sheet of paper.

2. Description of the Related Art

An image forming apparatus is constructed by a copying machine, a laser printer, a facsimile, etc. A space for an office automation (OA) equipment such as the image forming apparatus has been recently reduced. In a paper feeding/conveying apparatus, a plurality of paper feeding cassettes or paper feeding trays are stacked with each other in a vertical direction. Such a paper feeding/conveying apparatus is formed and separated from a body of the image forming apparatus. The paper feeding/conveying apparatus is arranged on a lower side of the body of the image forming apparatus to reduce an area for arranging the paper feeding/conveying apparatus. The paper feeding/conveying apparatus having such a structure has gradually spread.

In general, a proposed and used paper feeding/conveying apparatus of this kind is disclosed in e.g., Japanese Utility Model Application Laying Open (KOKAI) No. 1-78629.

A method for conveying a sheet of paper by frictional force of each of elastic rollers is used in such an apparatus and uses a simple structure so that this method is widely used. However, in such a method, a coefficient of friction of rubber used for the elastic conveying rollers is reduced with the passage of time. Further, a slip of the conveying rollers is caused by the generation of paper powder and the sheet of paper is jammed in a connection section between the conveying rollers and guide plates since the sheet of transfer paper is wound therearound in an environment of high humidity.

In Japanese Utility Model Application No. 1-78713, the same applicant as this patent application proposed a paper feeder for a printer having a simple structure. In this structure, a sheet of paper is fed by a single paper feeding roller to a recording section from plural paper feeding trays stacked with each other in a vertical direction.

In a conveying mechanism having this structure, a slidable paper feeding base is further arranged on paper feeding bases of a general one tray system in a paper conveying direction. Accordingly, in consideration of a layout of this mechanism, it is difficult to store a large amount of sheets such as 1000 sheets of paper on one paper feeding base. To store such a large amount of paper sheets on one paper feeding base, the size of a paper feeding section is increased so that the entire printer is large-sized.

Further, such a paper feeding base including plural paper feeding trays having sheets of paper thereon must be moved in the vertical direction every time a size and a kind of the sheets of paper are changed and the position of an upper face of the sheets of paper within a cassette is lowered from an allowable range during a paper feeding operation. Accordingly, a large power is required to operate this mechanism.

In Japanese Patent Application No. 1-117374, the same applicant as this application proposed a very novel conveyer for conveying a sheet member, etc. In this conveyer, an alternating electric charge density pattern is formed on an endless belt made of a dielectric substance. Thus, the sheet member is adsorbed and conveyed by adsorbing force generated by this electric charge density pattern.

However, in this proposal of the conveyer, no method for feeding sheets of paper stored on a paper feeding tray, etc. is shown. In this proposal, the sheets of paper are fed by a general paper feeding roller, etc. as a premise. In this respect, no problems about the above general paper feeding/conveying apparatus can be completely solved.

For example, Japanese Patent Application Laying Open (KOKAI) No. 59-212856 discloses a paper conveyer for an electrophotographic copying machine. In this paper conveyer, no paper feeding trays are arranged at a plurality of stages. However, a single insulating endless belt is used to feed and convey a sheet of transfer paper from a paper feeding section of the copying machine to an inserting section of a fixing device through a transfer section. A method for adsorbing the sheet of transfer paper to the endless belt is different from an adsorbing method using the adsorbing principle applied by forming the above-mentioned electric charge density pattern. Namely, in this adsorbing method, the insulating endless belt is charged by using a charging means to electrostatically adsorb the sheet of transfer paper by a difference in potential between the sheet of transfer paper and the insulating endless belt.

In accordance with this conveying method, it is possible to reliably convey the sheet of paper without any fear of the generation of a paper jam, etc. Further, the structure of a conveying mechanism is simplified and cost thereof is simultaneously reduced. Further, no paper powder is generated, or an amount of the paper powder is greatly reduced since the conveying means and the sheet of paper do not come in frictional contact with each other.

Japanese Patent Application Laying Open (KOKAI) No. 63-139846 discloses another paper conveyer. In this paper conveyer, a paper feeding section of a copying machine, a resist section, a transfer section, a fixing section and a paper discharging section are sequentially connected to each other through a single endless belt. First, the endless belt comes in press contact with a sheet of copy paper held by a copy paper feeding/holding section. The sheet of copy paper is then discharged from the copy paper feeding/holding section by frictional force. After a resisting operation of this sheet, the paper sheet is conveyed to the transfer section and a toner image is transferred onto this paper sheet by a photosensitive body. Then, the paper sheet is fixed by the fixing section and is discharged therefrom.

In this paper conveyer, it is possible to simply and reliably move the sheet of copy paper and each of the respective constructional sections in the copying machine, and control the movement of the sheet of copy paper in a feeding direction thereof.

However, each of the above-mentioned various devices for feeding and conveying a sheet of paper by using the above endless belt is used to feed the sheet of paper from a single paper feeding tray. Accordingly, such devices cannot be used in a multistage paper feeding/conveying apparatus in which paper feeding containers are arranged at plural stages in a vertical direction.

SUMMARY OF THE INVENTION

It is therefore an object of the present invention to provide multistage paper feeding/conveying apparatus and method in consideration of the above-mentioned problems of the general multistage paper feeding/conveying apparatus and the advantages of a conveyer in which a paper feeding section, a conveying section and an endless conveying belt, especially, a dielectric belt for forming an electric charge density pattern and adsorbing and conveying a sheet of paper are constructed by a single endless belt.

Namely, the object of the present invention is to provide for a multistage paper feeding/conveying apparatus and method in which a dielectric belt having a means for forming an electric charge density pattern is used to feed a sheet of paper one by one from selected one of paper storing means arranged at multiple stages in a vertical direction, and the sheet of paper can be conveyed to an image forming apparatus arranged on the multistage paper feeding/conveying apparatus.

Further, the object of the present invention is to provide means for solving additional problems with respect to the paper feeding/conveying apparatus.

The above object of the present invention can be achieved by a multistage paper feeding/conveying apparatus comprising a plurality of recording paper storing means vertically arranged at multiple stages; paper feeding means for feeding a sheet of recording paper one by one from arbitrary one of the recording paper storing means; and vertical conveying means vertically extending and opposed to a paper feeding side of each of the recording paper storing means, the vertical conveying means conveying the sheet of recording paper fed from the paper feeding means to a paper receiving section of an image forming apparatus arranged on an upper side of the multistage paper feeding/conveying apparatus. The paper feeding means has a single paper feeding unit which can selectively come in contact with a front end portion of an uppermost sheet of recording paper on an upper face thereof with respect to sheets of recording paper stored within the plurality of recording paper storing means. The paper feeding unit and the vertical conveying means have a single endless conveying belt which is wound around a group of rollers disposed in the paper feeding unit and a group of rollers disposed in an apparatus frame and is moved through a paper feeding section and the paper receiving section of the image forming apparatus. The paper feeding unit and the vertical conveying means further have means for forming an electric charge pattern for adsorbing the sheet of recording paper to the endless conveying belt.

The above object of the present invention can be also achieved by a method for feeding a sheet of recording paper in a multistage paper feeding/conveying apparatus in which a plurality of recording paper storing means are vertically arranged at multiple stages; a vertical conveying path vertically extends and is opposed to a paper feeding side of each of the recording paper storing means; a single paper feeding unit can selectively come in contact with a front end portion of an uppermost sheet of recording paper on an upper face thereof with respect to sheets of recording paper stored within the plurality of recording paper storing means; a single endless conveying belt extended to the vertical conveying path and the single paper feeding unit from arbitrary one of the plurality of recording paper storing means and an electric charge pattern for adsorbing the sheet of recording paper is formed on the endless conveying belt; and the sheet of recording paper is fed and conveyed one by one by the endless conveying belt to a paper receiving section of an image forming apparatus arranged on an upper side of the multistage paper feeding/conveying apparatus. The recording paper feeding method comprises the steps of a process for forming the electric charge pattern in a recording paper adsorbing region; a contact region forming process for horizontally inserting the endless conveying belt within the paper feeding unit onto the sheet of recording paper within the recording paper storing means so as to form a contact region between the endless conveying belt and a front end portion of the sheet of recording paper; a lowering process for lowering the paper feeding unit until a lower face of the endless conveying belt in the contact region reaches a position located by a predetermined distance above an upper face of the sheets of recording paper within the recording paper storing means; a speed changing process for changing a relative speed of the endless conveying belt with respect to the sheet of recording paper such that the relative speed is approximately equal to zero in at least the contact region; a contact adsorbing process for further lowering the paper feeding unit to make the endless conveying belt at the approximately zero relative speed in the contact region come in contact with the upper face of the sheets of recording paper so that the sheet of recording paper is adsorbed to the endless conveying belt; a raising process for raising the paper feeding unit until a predetermined position; and a paper feeding process for returning a conveying speed of the endless conveying belt in the contact region to a predetermined conveying speed and feeding and conveying the sheet of recording paper.

In the above-mentioned multistage paper feeding/conveying apparatus of the present invention, a sheet of recording paper is fed and conveyed by the above-mentioned paper feeding method. Accordingly, the relative speed of the endless conveying belt with respect to sheets of recording paper is changed and approximately set to zero in the contact region of the belt formed in a position located by a predetermined distance above a front end portion of the sheets of recording paper on an upper face thereof stored within a selected recording paper storing means. The endless conveying belt then comes in contact with the front end portion of the sheets of recording paper on the upper face thereof. An uppermost sheet of recording paper with respect to the stored sheets of recording paper is adsorbed to an electric charge pattern formed in advance in a range corresponding to a support range of the sheet of recording paper. This uppermost sheet of paper is then conveyed to the paper receiving section of the image forming apparatus by the endless conveying belt extending to the paper feeding unit and the vertical conveying means.

Accordingly, there is no fear of generation of a shift in position between the sheet of recording paper and the conveying belt. Since the relative speed of the conveying belt is approximately equal to zero at a paper feeding time, no paper power is generated by friction and there is no slip of the belt by a reduction in frictional coefficient thereof. Further, there is no possibility of a paper sheet jam in a connection section between a conveying member and a guide member.

The paper feeding unit is lowered to a position in contact with the upper face of the sheets of recording paper within each of the recording paper storing means. The paper feeding unit then adsorbs the uppermost sheet of recording paper thereto and feeds this uppermost sheet. Accordingly, it is not necessary to vertically move the recording paper storing means and the sheets of paper stored therein. Therefore, it is sufficient to raise and lower only the paper feeding unit which is light in weight, thereby reducing power and quickly performing the paper feeding operation.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a multistage paper feeding/conveying apparatus in the present invention will next be described in detail with reference to the accompanying drawings.

Figure 1:
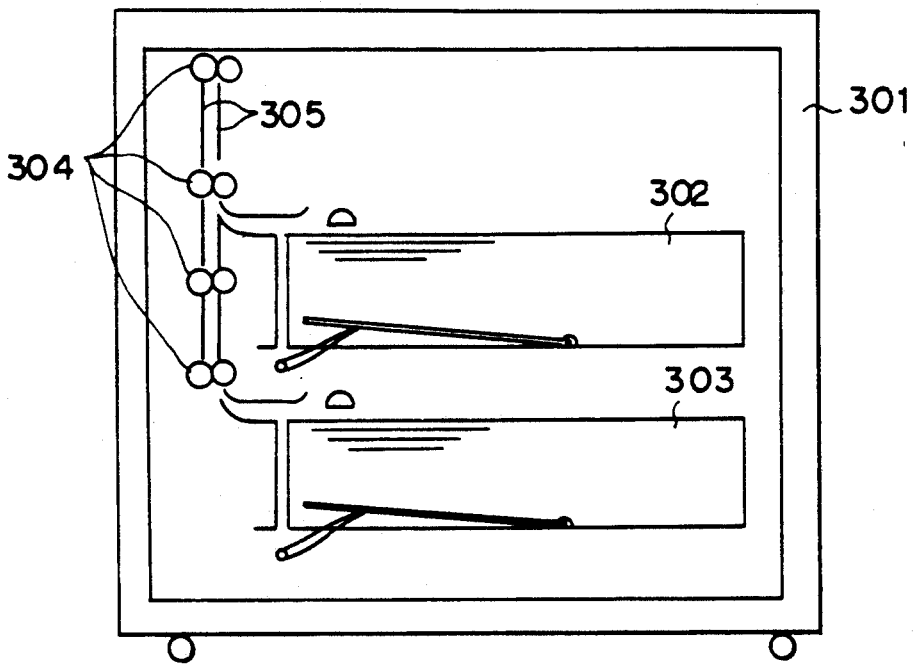
Fig. 1 PRIOR ART
FIGS. 1 and 2 are side sectional views showing one example of the construction of a general multistage paper feeding/conveying apparatus.

In general, a proposed and used paper feeding/conveying apparatus of this kind is disclosed in e.g., Japanese Utility Model Application Laying Open (KOKAI) No. 1-78629. Such a paper feeding/conveying apparatus is shown in FIG. 1. In FIG. 1, paper feeding bases or containers 302 and 303 are constructed by a plurality of paper feeding cassettes or paper feeding trays, etc. vertically stacked with each other within a housing 301. A sheet of paper is selectively fed from the paper feeding bases 302 and 303 and is then conveyed upward along a vertical conveying path. This vertical conveying path is constructed by conveying rollers 304 formed by an elastic body and pairs of guide plates 305. The conveying rollers 304 are opposed to paper feeding ends of the paper feeding containers and are arranged in a vertical direction in accordance with a minimum size of the sheet of paper. The guide plates 305 are arranged between the conveying rollers 304. The sheet of paper is then fed to the body of an image forming apparatus.

A method for conveying the sheet of paper by frictional force of each of the conveying rollers uses a simple structure so that this method is widely used. However, in such a method, a coefficient of friction of rubber used for the conveying rollers is reduced with the passage of time. Further, a slip of the conveying rollers is caused by generation of paper powder and the sheet of paper is jammed in a connection section between the conveying rollers and the guide plates since the sheet of transfer paper is wound therearound in an environment of high humidity.

Figure 2:
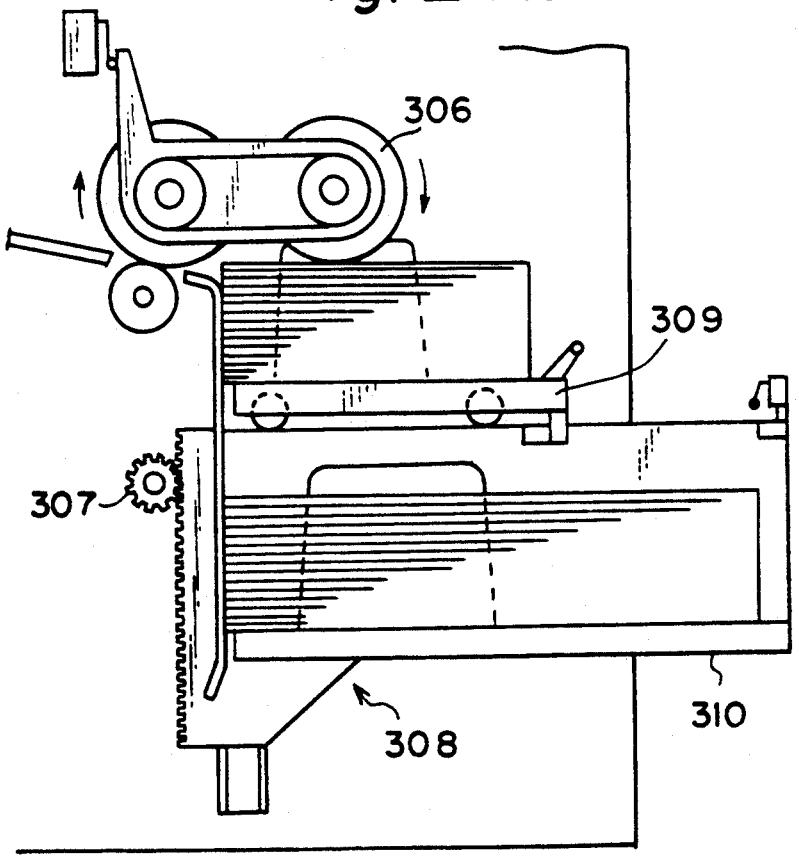
Fig. 2 PRIOR ART

In Japanese Utility Model Application No. 1-78713, the same applicant as this patent application proposed a paper feeder for a printer having a simple structure. In this structure, a sheet of paper is fed by a single paper feeding roller to a recording section from plural paper feeding trays stacked with each other in a vertical direction. As shown in FIG. 2, this paper feeder has a conveying mechanism section having a single paper feeding roller 306, a paper feeding base 308 and a single drive unit 307 for raising and lowering the paper feeding base 308. The paper feeding base 308 has a plurality of paper feeding trays 309 and 310 stacked with each other in the vertical direction. The respective paper feeding trays except for the lowermost tray 310 are constructed by only the paper feeding tray 309 in FIG. 2 and can be separately slid in a paper conveying direction for a constant distance. This constant distance is set to a distance between two positions. One position is set to a position in which a front end portion of each of sheets of paper arranged on the paper feeding tray 309 reaches an operating range of the paper feeding roller 306 of the above conveying mechanism section. The other position is set to a position in which the front end of each of the sheets of paper is escaped backward from the paper feeding roller 306.

Accordingly, a paper feeding tray having a sheet of paper thereon to be fed is held in the position in which the front end portion of this sheet of paper reaches the operating range of the paper feeding roller. An upper paper feeding tray arranged above this paper feeding tray is moved backward to a position in which the front end portion of the sheet of paper is located outside the paper feeding roller 306. The paper feeding base 308 is raised by the single drive unit 307 for raising and lowering this paper feeding base. At this time, the upper paper feeding tray arranged above the paper feeding tray having the sheet of paper thereon to be fed and sheets of paper arranged on this upper paper feeding tray are raised behind the paper feeding roller without coming in contact with this paper feeding roller. Each of sheets of paper to be fed comes in press contact with the paper feeding roller in the vicinity of a front end of this paper sheet on an upper face thereof. The upper face of each of the sheets of paper is then stopped in a predetermined position by a well-known upper limit sensor. Thus, the sheet of paper having a desirable size can be automatically fed by the paper feeding roller.

In this mechanism, a slidable paper feeding base is further arranged on the paper feeding bases of a general one tray system in the paper conveying direction. Accordingly, in consideration of a layout of this mechanism, it is difficult to store a large amount of sheets such as 1000 sheets of paper on one paper feeding base. To store such a large amount of paper sheets on one paper feeding base, the size of a paper feeding section is increased so that the entire printer is large-sized.

Further, the paper feeding base 308 including the plural paper feeding trays having sheets of paper thereon must be moved in the vertical direction every time a size and a kind of the sheets of paper are changed and the position of an upper face of the sheets of paper within a cassette is lowered from an allowable range during a paper feeding operation. Accordingly, a large power is required to operate this mechanism.

In Japanese Patent Application No. 1-117374, the same applicant as this application proposed a very novel conveyer for conveying a sheet member, etc. In this conveyer, an alternating electric charge density pattern is formed on an endless belt made of a dielectric substance. Thus, the sheet member is adsorbed and conveyed by adsorbing force generated by this electric charge density pattern.

The principle of this conveyer is as follows.

Figure 3:
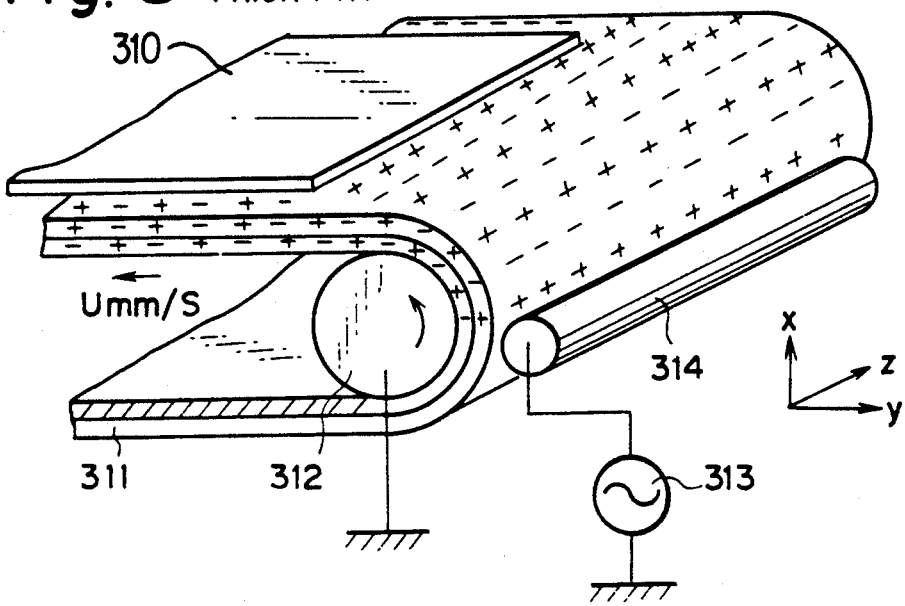
Fig. 3 PRIOR ART
FIGS. 3 to 7 are views for explaining the principle of a conveyer for forming an electric charge density pattern on a dielectric belt and adsorbing and conveying a sheet of paper.

As shown in FIG. 3, a belt 311 is disposed to feed and convey a sheet of transfer paper 310, etc. The belt 311 is rotatably supported by a driving roller and a plurality of belt support rollers 312. The belt 311 is constructed by an endless belt in which a surface layer is formed by a dielectric substance capable of holding a charge and a rear face is formed by a semiconductor layer. The rear face of the belt 311 comes in contact with at least one support roller connected to the ground. An alternating electric field (AHz) is applied to a roller 314 from a high voltage power source 313 with the above ground support roller 312 as an opposite electrode.

The belt 311 is moved by the driving roller at a constant speed of U mm/s in an arrow direction in FIG. 3. A pickup position of the sheet is located on a downstream side with respect to a contact position between the belt 311 and the roller 314 in a moving direction of the belt 311. Accordingly, an alternating voltage is applied to the belt 311 from the high voltage power source through the roller 314 before the sheet is fed onto a surface of the belt 311. Thus, an electric charge density pattern having a stripe shape is formed on the surface of the belt 311. In this electric charge density pattern, electric charge densities $-\sigma$ and $+\sigma$ are alternately formed and arranged at a period of U/A mm. Charges having opposite signs are induced by the electric densities formed on the belt surface in the semiconductor layer on the rear face of the belt 311.

Figure 4:
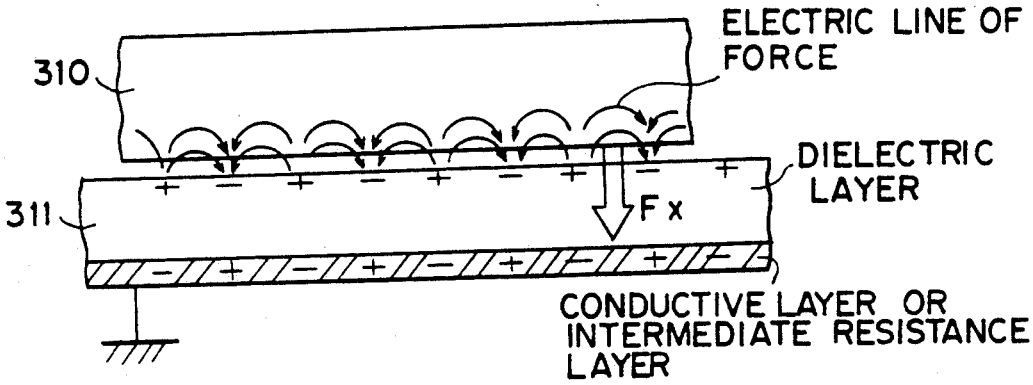
Fig. 4 PRIOR ART

As shown in FIG. 4, a non-uniform electric field is formed by such an electric charge density pattern in the vicinity of the surface of the belt 311. Force applied by this electric field to a unit volume of the dielectric substance constituting the sheet 310 is represented by the following formula using a Maxwell stress tensor. The sheet 310 is electrostatically adsorbed and held by the belt 311 by force fx perpendicular to a sheet face without causing any shift in this sheet. Thus, the sheet 310 is fed and conveyed by the belt 311.

In the following description, reference numerals x and y respectively designate a direction perpendicular to the sheet face, and a conveying direction of the sheet. Reference numeral 2 designates a direction perpendicular to the conveying direction on the sheet face. Reference numerals fx, fy and fz respectively designate components of the force applied to the unit volume of the dielectric substance in the x, y and z directions. In this case, the component forces fx, fy and fz are respectively provided as follows.

The Maxwell stress tensor is provided as follows.

$$\begin{bmatrix} E_xD_x - \frac{1}{2}(E\cdot D) & E_xD_y & E_xD_z \\ E_yD_x & E_yD_y - \frac{1}{2}(E\cdot D) & E_yD_z \\ E_zD_x & E_zD_y & E_zD_z - \frac{1}{2}(E\cdot D) \end{bmatrix}$$

Accordingly, component forces fx, fy and fz are represented as follows.

$$f_x = \frac{\partial}{\partial x}\left\{E_xD_x - \frac{1}{2}(E\cdot D)\right\} + \frac{\partial}{\partial y}(E_xD_y) + \frac{\partial}{\partial z}(E_xD_z)$$

$$f_y = \frac{\partial}{\partial x}(E_yD_x) + \frac{\partial}{\partial y}\left\{E_yD_y - \frac{1}{2}(E\cdot D)\right\} + \frac{\partial}{\partial z}(E_yD_z)$$

$$f_z = \frac{\partial}{\partial x}(E_zD_x) + \frac{\partial}{\partial y}(E_zD_y) + \frac{\partial}{\partial y}\left\{E_zD_z - \frac{1}{2}(E\cdot D)\right\}$$

In the above formulas, reference numerals E and D respectively designate an electric field and an electric flux density. Indices x, y and z of E and D respectively designate components of the electric field and the electric flux density in the x, y and z directions.

An applied voltage may be provided by superimposing a direct current component on the alternating voltage.

This adsorbing principle is different from the principle of normally known attractive force between charges having different signs. In accordance with this adsorbing principle, the sheet of transfer paper can be adsorbed to the belt 311 by using the above-mentioned method without giving any charge to the sheet of transfer paper. Therefore, there is no influence of the adsorbing force in a transfer process even when this adsorbing principle is used in a paper feeding/conveying apparatus of an electrostatic recorder.

One example of a method for measuring the adsorbing force in this sheet member conveyer and one example of measured results using this method will next be described.

Figure 5:
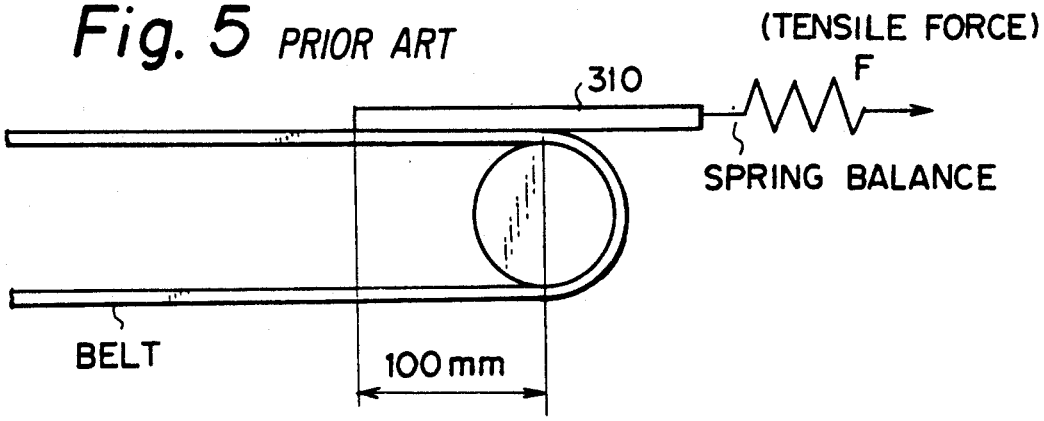
Fig. 5 PRIOR ART

As shown in FIG. 5, a sheet of plain paper 310 having size A3 is fed to the conveying belt. When a contact length between the paper sheet and the conveying belt reaches 100 mm, the adsorbing force is measured as tensile force by attaching a spring balance to the paper sheet at a rear end thereof. At this time, an adsorbing area is set to 300 $cm^2$.

Figure 6:
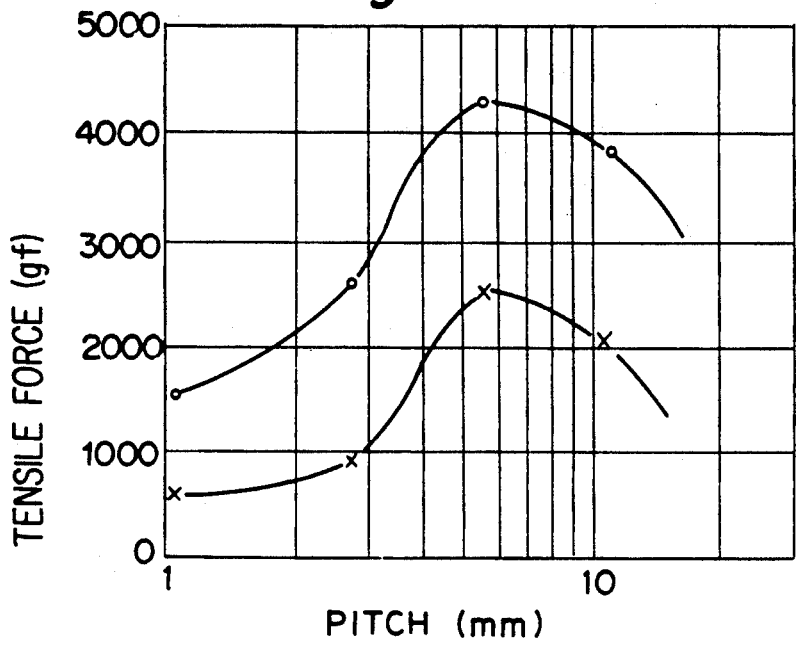
Fig. 6 PRIOR ART

FIG. 6 shows periodic characteristics of a two-layer structure. In FIG. 6, reference character x shows a two-layer belt including polyester in which a surface layer has a thickness of 20 $\mu$m and $10^{16}$ $\Omega$cm and a rear face layer has a thickness of 80 $\mu$m and $10^8$ $\Omega$cm. Reference character o shows aluminum evaporation Mylar having a thickness of 50 $\mu$m. As shown in FIG. 6, the adsorbing force is measured when an amplitude of the alternating voltage is set to be a constant amplitude such as 4 kVp-p and an applied frequency is changed. In the present invention, sufficient adsorbing force can be obtained when the period of the stripe shape is set in the range of a pitch equal to or smaller than 20 mm.

Figure 7:
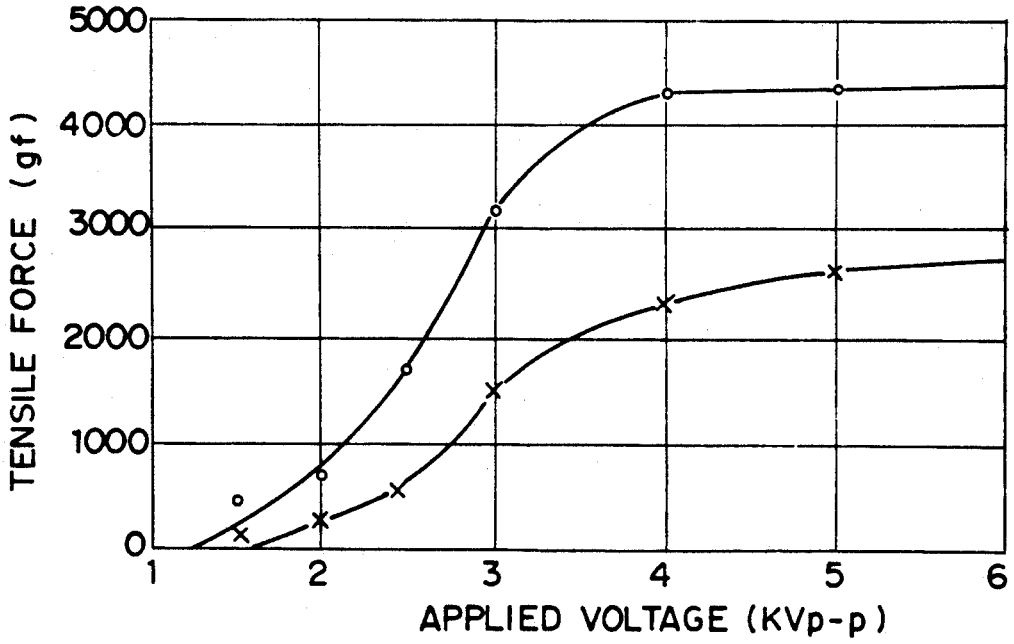
Fig. 7 PRIOR ART

FIG. 7 shows voltage characteristics of the belt having the two-layer structure. In FIG. 7, reference character x shows the two-layer belt including polyester in which the surface layer has a thickness of 20 $\mu$m and $10^{16}$ $\Omega$cm and the rear face layer has a thickness of 80 $\mu$m and $10^8$ $\Omega$cm. Reference character o shows aluminum evaporation Mylar. As shown in FIG. 7, the adsorbing force is measured when the applied frequency is set to a constant frequency such as 26 Hz and the applied voltage is changed. As a result, preferable adsorbing force can be obtained when the amplitude of the alternating voltage is equal to or greater than 2 kVp-p. At this time, it is found by measuring a surface potential that no charge density pattern is formed on the belt at the applied voltage at which no adsorbing force is generated. Accordingly, the applied voltage equal to or higher than at least a voltage for starting a charging operation is required to generate the adsorbing force.

Such an applied voltage is similarly required when the applied voltage is provided by superimposing a direct current component on the alternating voltage and a non-uniform alternating voltage is applied to the belt from a power source for outputting a non-uniform alternating voltage.

In this proposal of the conveyer, no method for feeding sheets of paper stored on a paper feeding tray, etc. is shown. In this proposal, the sheets of paper are fed by a general paper feeding roller, etc. as a premise. In this respect, no problems regarding the above general paper feeding/conveying apparatus can be completely solved.

For example, Japanese Patent Application Laying Open (KOKAI) No. 59-212856 discloses a paper conveyer for an electrophotographic copying machine. In this paper conveyer, no paper feeding trays are arranged at a plurality of stages. However, a single insulating endless belt is used to feed and convey a sheet of transfer paper from a paper feeding section of the copying machine to an inserting section of a fixing device through a transfer section. A method for adsorbing the sheet of transfer paper to the endless belt is different from an adsorbing method using the adsorbing principle applied by forming the above-mentioned electric charge density pattern. Namely, in this adsorbing method, the insulating endless belt is charged by using a charging means to electrostatically adsorb the sheet of transfer paper by a difference in potential between the sheet of transfer paper and the insulating endless belt.

Figure 8:
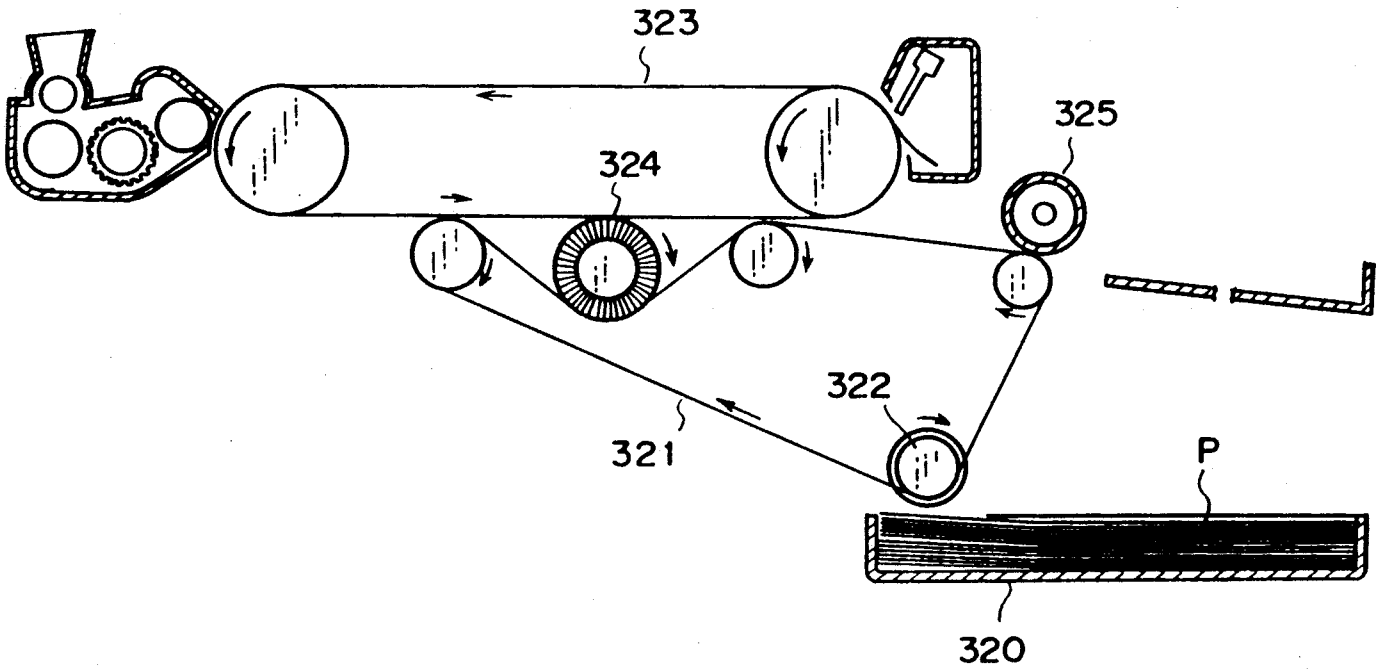
Fig. 8 PRIOR ART
FIG. 8 is a cross-sectional view showing one example of a general conveyer for feeding and conveying the sheet of paper by a single endless belt.

As shown in FIG. 8, a support roller 322 of an endless belt 321 is disposed in the vicinity of a front end of sheets P of paper stored within a paper feeding tray 320 such that this support roller 322 is opposed to this front end on an upper face thereof. The support roller 322 is moved in synchronization with the movement of an image region formed on a photosensitive body 323 such that the support roller 322 is located in proximity to the paper sheets P. A feed roller **322*a* coaxially disposed with the support roller 322 then comes in contact with a sheet of paper to feed this sheet. The fed sheet of paper is adsorbed and conveyed by the endless belt. The sheet of paper is then transferred by a transfer section 324 in a state in which a front end of the paper sheet is in conformity with that of a toner image formed on the photosensitive body 323. Thereafter, the transferred sheet of paper is conveyed to a fixing section 325**.

In accordance with this conveying method, it is possible to reliably convey the sheet of paper without any fear of the generation of a paper jam, etc. Further, the structure of a conveying mechanism is simplified and cost thereof is simultaneously reduced. Further, no paper powder is generated, or an amount of the paper powder is greatly reduced since the conveying means and the sheet of paper do not come in frictional contact with each other.

Japanese Patent Application Laying Open (KOKAI) No. 63-139846 discloses another paper conveyer. In this paper conveyer, a paper feeding section of a copying machine, a resist section, a transfer section, a fixing section and a paper discharging section are sequentially connected to each other through a single endless belt. First, the endless belt comes in press contact with a sheet of copy paper held by a copy paper feeding/holding section. The sheet of copy paper is then discharged from this copy paper feeding/holding section by frictional force. After a resisting operation of this sheet, the paper sheet is conveyed to the transfer section and a toner image is transferred onto this paper sheet by a photosensitive body. Then, the paper sheet is fixed by the fixing section and is discharged therefrom.

In this paper conveyer, it is possible to simply and reliably move the sheet of copy paper and each of the respective constructional sections in the copying machine, and control the movement of the sheet of copy paper in a feeding direction thereof.

However, each of the above-mentioned various devices for feeding and conveying a sheet of paper by using the above endless belt is used to feed the sheet of paper from a single paper feeding tray. Accordingly, such devices cannot be used in a multistage paper feeding/conveying apparatus in which paper feeding containers are arranged at plural stages in a vertical direction.

The preferred embodiments of a multistage paper feeding/conveying apparatus in the present invention will next be described in detail with reference to FIGS. 9 to 24.

I. A copying system will first be explained schematically.

Figure 9:
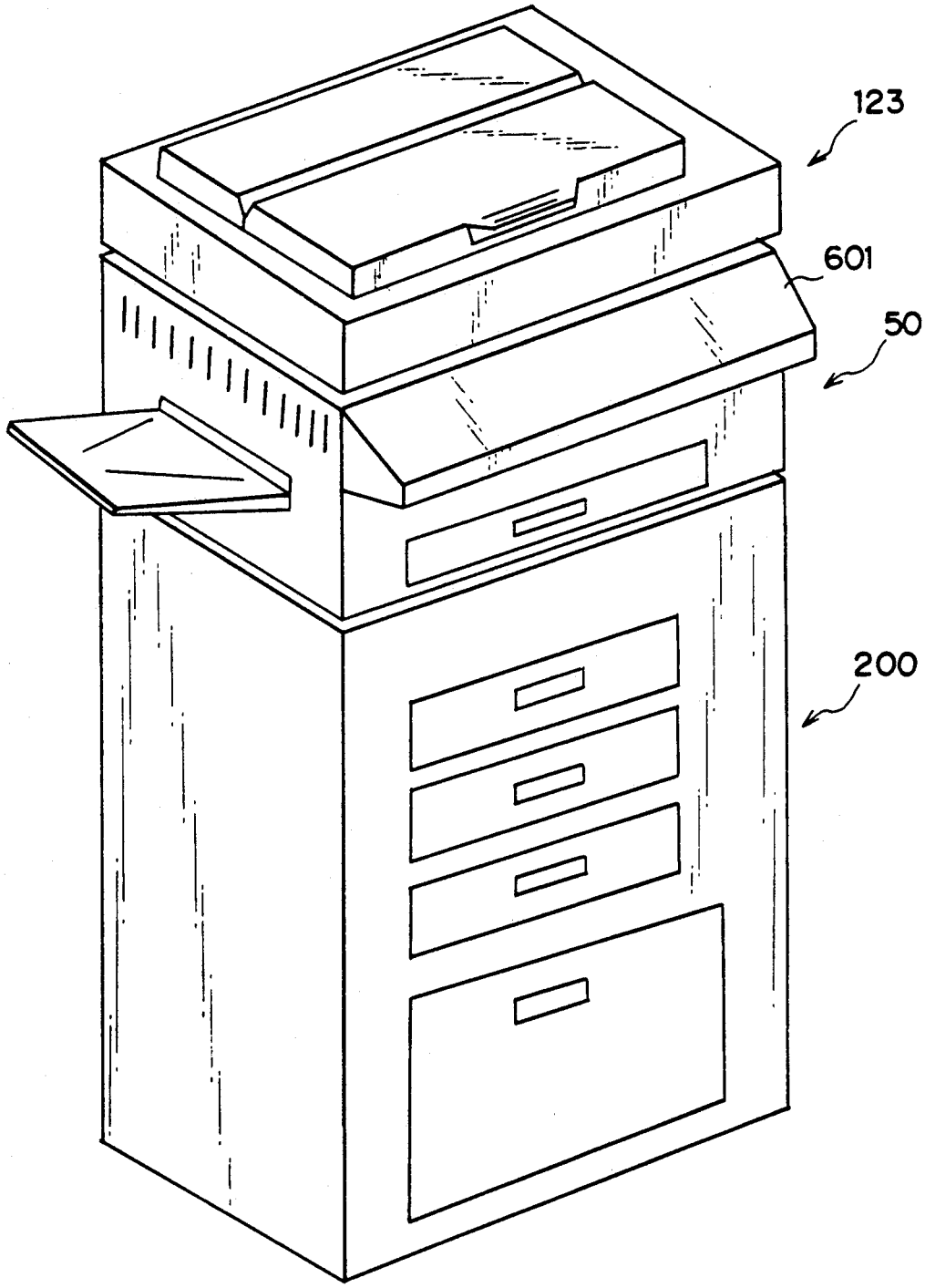
FIG. 9 is a perspective view showing an external appearance of a copying system as one example having a multistage paper feeding/conveying apparatus in the present invention.
Figure 10:
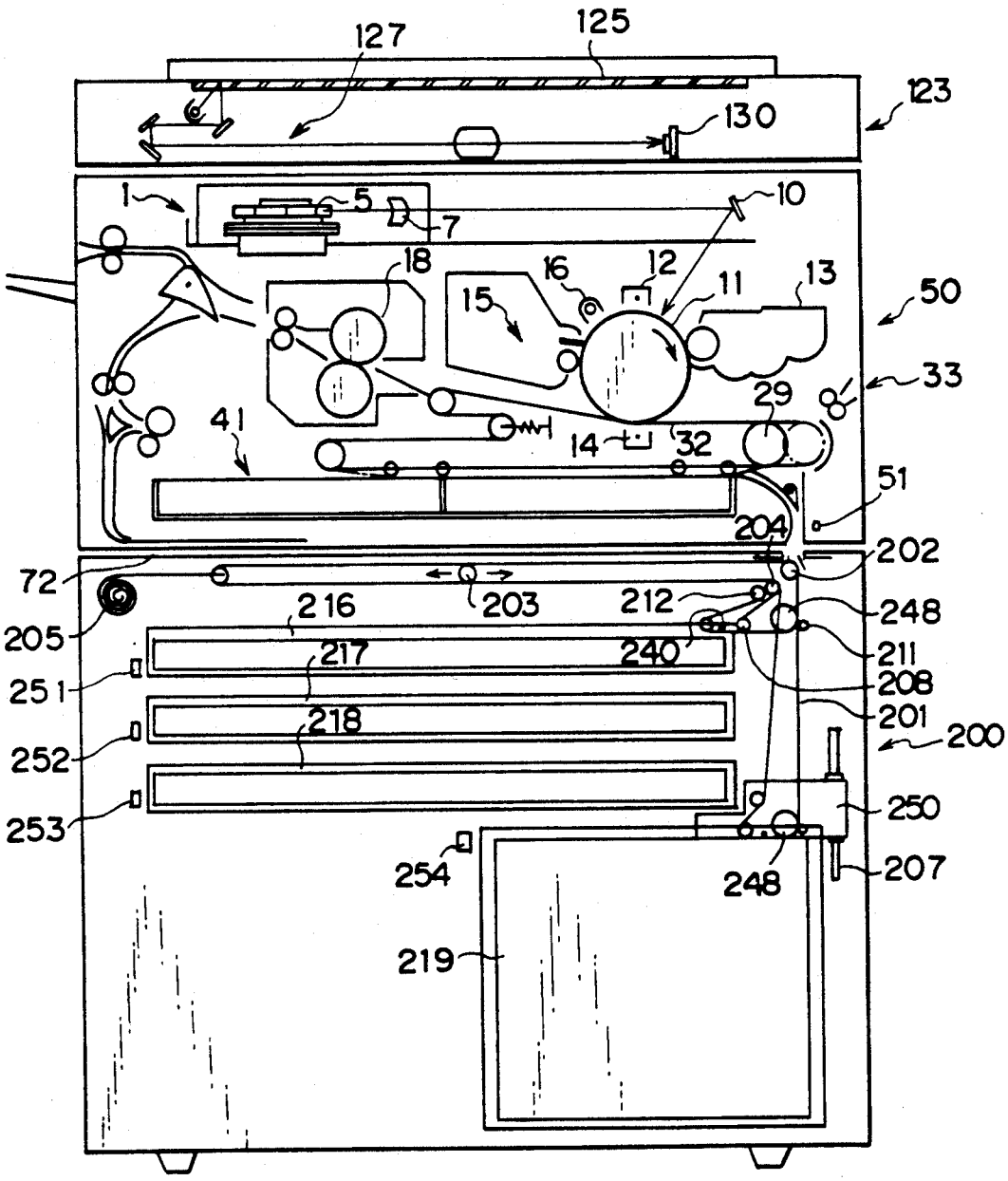
FIG. 10 is a side sectional view showing a schematic construction of each of constructional devices of the copying system.

FIG. 9 is a perspective view showing an external appearance of the copying system provided with a multistage paper feeding/conveying apparatus (which is called a paper bank in the following description) in the present invention. FIG. 10 is a cross-sectional view showing the structure of each of constructional devices disposed in the copying system.

The copying system is constructed by the body 50 of a copying machine, a scanner 123 as an original reader and a paper bank (which is briefly called PB in some cases in the following description). The copying machine, the scanner 123 and the paper bank are operated by an operating section 601 disposed on an operating side of the copying machine body 50.

The copying machine is constructed by a digital copying machine. An original is arranged on a contact glass 125 of the scanner 123 and an image of the original is projected onto a charge coupled device (CCD) 130 through a reading optical system 127, thereby reading this image. A predetermined image processing is performed with respect to an information signal of the read image. An emitted laser beam is transmitted to a laser optical writing section 1 and is formed as an image on a photosensitive body drum 11 through a write optical system composed of a rotary polygon mirror 5, an f$\theta$ lens 7, a reflecting mirror 10, etc., thereby performing an optical writing operation of this image. A charger 12, an incident position of the above laser beam, a developing device 13, a transfer charger 14, a cleaner 15 and a charge removing lamp 16 are sequentially arranged around the photosensitive body drum 11 in a rotational direction thereof shown by an arrow in FIG. 10. A toner image is formed on the photosensitive body drum 11 by a well-known electrostatic photographic process.

This toner image is transferred onto a sheet of transfer paper fed to a transfer section by an operation of the transfer charger 14. After the transfer of the toner image, the sheet of transfer paper is separated from the photosensitive body drum 11 and is conveyed to a fixing device 18. After the sheet of transfer paper is fixed by this fixing device 18, the sheet of paper is discharged from the fixing device 18. Otherwise, the sheet of paper is turned upside down in accordance with necessity in the cases of a double-sided copy and a combined copy. The sheet of paper is then fed to the transfer section again.

In the copying machine shown in FIGS. 9 and 10, the sheet of transfer paper is taken out of a paper feeding section and is then conveyed to the transfer section and a fixing section by using an endless conveying belt 32. The sheet of transfer paper is adsorbed to the endless conveying belt 32 by a flexible feeding system utilizing adsorbing force caused by an electric charge density pattern formed on the conveying belt in accordance with the above-mentioned principle. A paper feeding means has a paper feeding cassette 41 which can be divided into first and second trays in tandem in a paper feeding direction within the copying machine body 50. The paper feeding means also has third to sixth paper feeding trays 216, 217, 218 and 219 vertically stacked with each other within the paper bank of the present invention. The sheet of paper can be manually fed from a manual paper feeding section 33.

The above flexible feeding system is separately proposed by the inventors of this patent application and an application of this feeding system is filed with the Japanese Patent Office. The copying machine used in combination with the paper bank of the present invention is not limited to a copying machine using the flexible feeding system. The flexible feeding system can be combined with an analog copying machine in which light reflected from the original is directly focused and formed as an image on the photosensitive body drum to perform an exposure operation thereof.

II. The paper bank is constructed as follows.

The paper bank 200 is constructed by a single paper feeding/conveying apparatus, the third to fifth trays 216, 217 and 218 each having 250 sheets of paper as a maximum loading capacity, and the sixth tray 219 having 2000 sheets of paper as a maximum loading capacity. An end face of each of the third to fifth trays 216, 217 and 218 on a paper feeding side thereof is arranged on one vertical face. An end face of the sixth tray 219 on a paper feeding side thereof is located forward from a position of the above end face of each of the third to fifth trays on the paper feeding side thereof. Each of the trays 216 to 219 is arranged within a housing and can be pulled out of the housing on the side seen from an operator and can be pushed into the housing on a deep side thereof by opening and closing a door of the housing.

The sheet of transfer paper is fed from these paper feeding trays and is conveyed to a paper receiving section disposed in the body of an image forming apparatus. In this case, a means for feeding and conveying the sheet of transfer paper uses the above-mentioned conveying method for forming an electric charge density pattern on the endless belt made of a dielectric substance and adsorbing the sheet of transfer paper to the endless belt.

Figure 11:
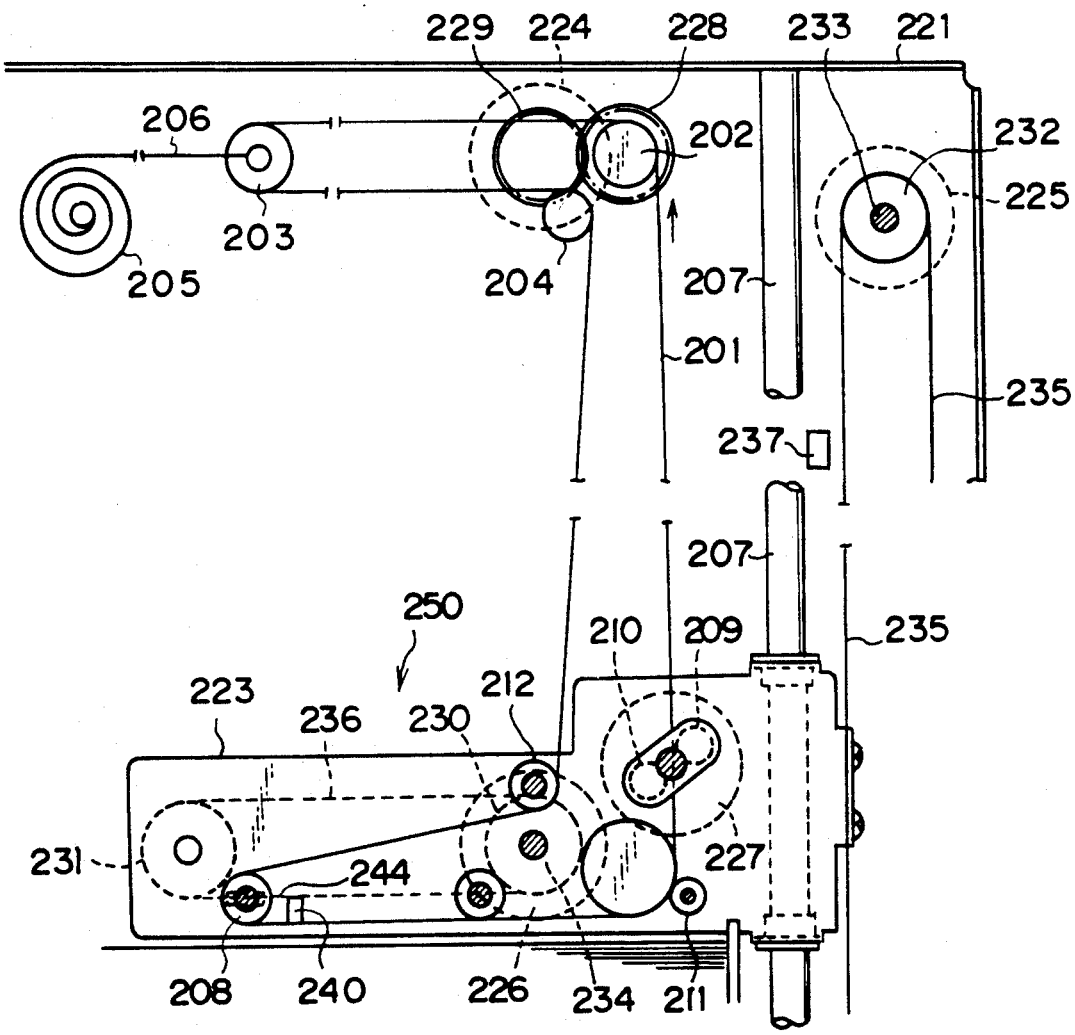
FIG. 11 is a side view showing the arrangements of a paper feeding unit and an endless belt disposed in a multistage paper feeding/conveying apparatus in accordance with one embodiment of the present invention.

As shown in FIGS. 10 and 11, the paper feeding/conveying apparatus has a single paper feeding unit 250 and a single PB belt 201. The single paper feeding unit 250 is slidable with respect to a sliding rod 207. The sliding rod 207 is opposed to the end face of each of the paper feeding trays on the paper feeding side thereof and is vertically arranged over an entire height of the housing of the paper bank. The single PB belt 201 is wound around a group of rollers arranged between side plates of the paper feeding unit 250 and between side plates of the paper bank. As shown in FIG. 4, the PB belt 201 is constructed by an endless belt of a two-layer type in which a front or upper layer is formed by a dielectric film (PET 50 $\mu$m) and a lower layer is formed by evaporation of aluminum. The PB belt 201 is movably supported by a driving roller 202 and a plurality of support rollers.

A volume resistivity of this dielectric substance of the PB belt 201 is set to $10^{16}$ $\Omega$ cm. An alternating voltage having $\pm 2$ kV and a frequency of 26 Hz is applied to a roller 212 from a high voltage power source B. The PB belt 201 is moved by the driving roller 202 at a constant speed of 130 mm/s in an arrow direction in FIG. 11. A feeding position of the sheet of transfer paper is located on a downstream side from a constant position of an electrode of the roller 212 in a moving direction of the PB belt. Accordingly, before the sheet of transfer paper is fed onto a surface of the PB belt, an electric charge density pattern is formed on the surface of the PB belt at a period or pitch of 5 mm.

In FIG. 11, the PB belt 201 is wound around the PB driving roller 202, a belt tension roller 203, a roller 204 and the paper feeding unit 250. A wire 206 is attached to the tension roller 203 on this side and the deep side thereof. The tension roller 203 is pulled by a spiral spring 205 through the wire 206 in a leftward direction in FIG. 11. Thus, tensile force is applied to the PB belt 201 through the tension roller 203. The PB driving roller 202 is rotated by a PB belt drive motor 224 through gears 228 and 229 in the counterclockwise direction in FIG. 11, thereby driving the PB belt 201.

Figure 12:
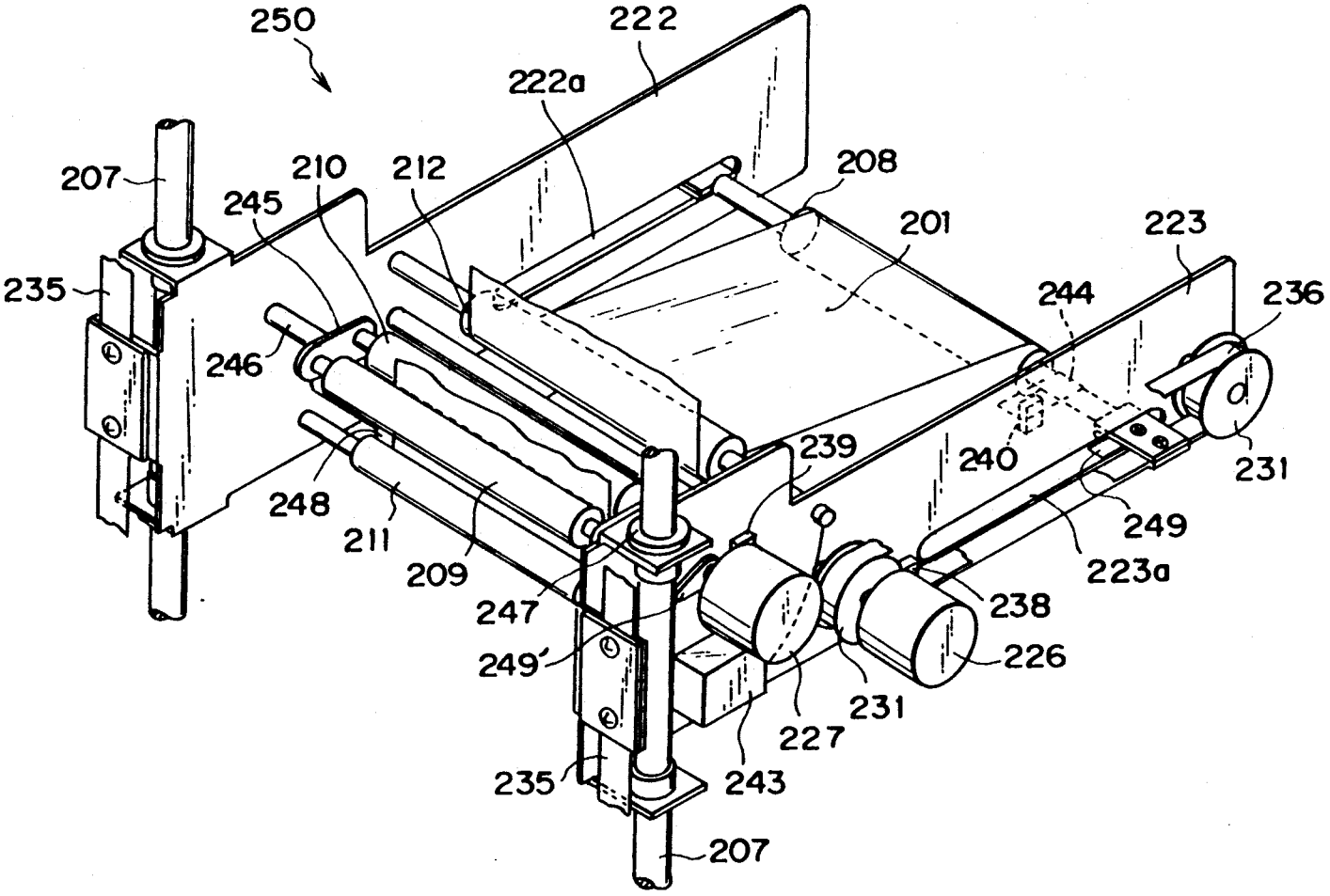
FIGS. 12 and 13 are respectively perspective and plan views showing the construction of the paper feeding unit.
Figure 13:
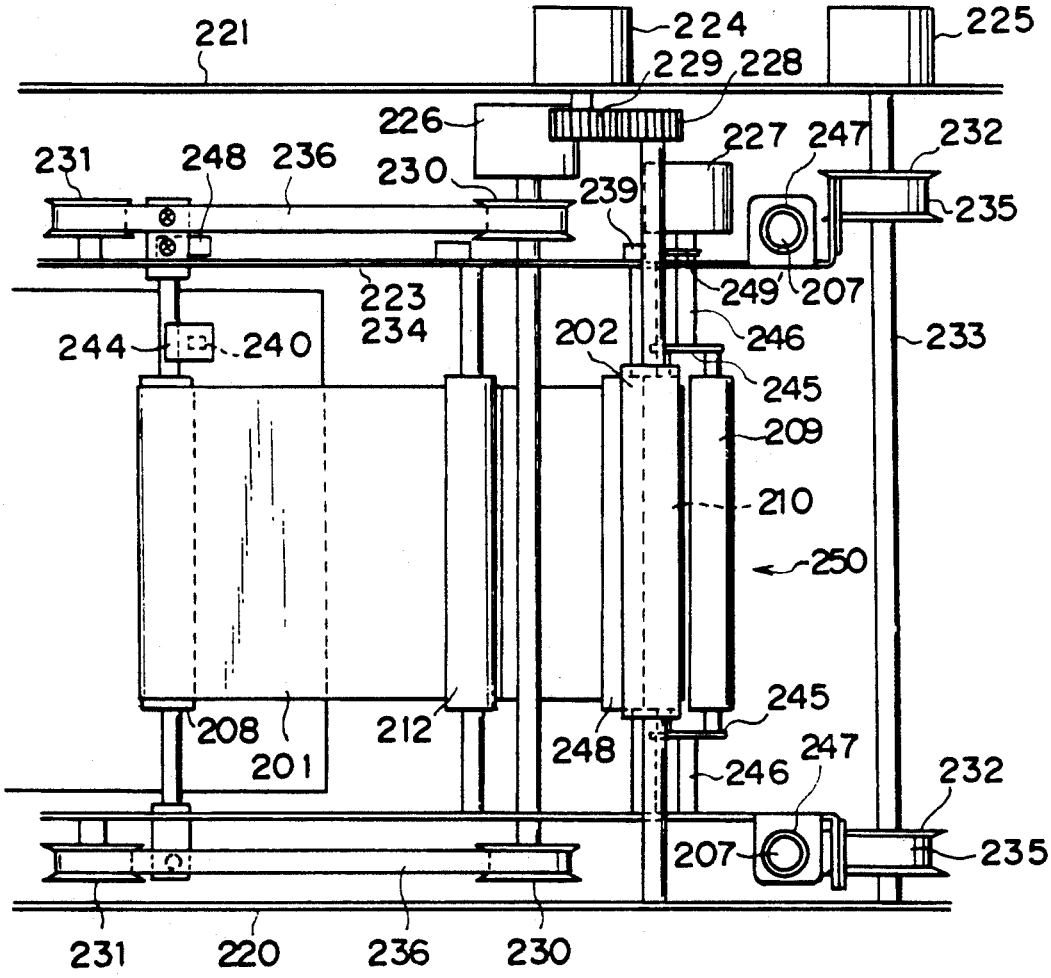

FIGS. 12 and 13 show the construction of the paper feeding unit 250. The left-hand and right-hand sides in FIG. 12 are opposite to those in FIG. 11 to show an outside face of a deep side plate 223 of the paper feeding unit as a pickup. A pickup roller 208, a rotating shaft 246 of a bracket 245, a pickup auxiliary roller 211 and a roller 248 are rotatably attached to the paper feeding unit 250 between a pickup front side plate 222 and the pickup deep side plate 223. The bracket 245 rotatably supports belt variable speed rollers 209 and 210 with axial symmetry.

Both ends of the pickup roller 208 are fixed to timing belts 236 wound around pulleys 230 and 231 at constant points. The pickup roller 208 can be moved by a PB pickup drive motor 226 leftward and rightward along slits 222*a* and 223*a* respectively disposed in the opposite side plates 222 and 223. A feeler 249 is disposed in an axial end portion of this pickup roller 208 to determine a home position thereof. A PB pickup sensor 238 is correspondingly disposed in the vicinity of a left-hand end of the slit 223*a* of the side plate 223 in FIG. 12. The PB pickup sensor 238 is operated by the above feeler 249 and detects that the pickup roller 208 is located in the home position.

A distance between the side plates 222 and 223 is larger than a width of each of the paper feeding trays. A support member for supporting each of the paper feeding trays is disposed in a position separated from positions of the pickup front side plate 222 and the pickup deep side plate 223. The end portion of each of the third to fifth paper feeding trays on the paper feeding side thereof is located in a position separated from the home position of the pickup roller 208.

A bracket 244 is attached to the axial end portion of the pickup roller 208. This bracket 244 supports a paper sheet upper end sensor 240 on a lower side thereof. The paper sheet upper end sensor 240 detects an upper end of the sheets of transfer paper within each of the paper feeding trays. This paper sheet upper end sensor 240 detects that the height of a fed paper face of the PB belt reaches 5 mm from the upper end of the paper sheets. The paper sheet upper end sensor 240 then determines the home position of a paper feeding operation from this height.

The belt variable speed rollers 209 and 210 wind the PB belt 201 therearound in advance before the paper feeding operation is started. The belt variable speed rollers 209 and 210 control a conveying speed of the PB belt 201 on a paper feeding face thereof by unwinding the PB belt 201 wound during the paper feeding operation. These winding and unwinding operations are performed by a PB belt variable speed motor 227. A feeler 249' is attached to the rotating shaft 246 of the bracket 245 for supporting the variable speed rollers 209 and 210 and detects home positions of the variable speed rollers 209 and 210. Correspondingly, a PB belt variable speed home position sensor 239 is operated by this feeler 249' in a home position thereof and is attached to the pickup deep side plate 223.

The roller 248 is disposed to change the conveying direction of a sheet of paper fed from the paper feeding face of the PB belt to a vertical direction. The pickup auxiliary roller 211 prevents the sheet of paper from being separated from the PB belt when the conveying direction of the sheet of paper is changed.

The paper feeding unit 250 is slidably attached to the sliding rod 207 through a bearing 247. The sliding rod 207 is vertically attached to a PB front side plate 220 and a PB deep side plate 221 in the vicinity of front ends thereof in a paper feeding direction. A shaft 233 is rotatably connected to upper and lower sections of the paper feeding unit 250 between the PB front side plate 220 and the PB deep side plate 221. Upper and lower pulleys 232 are fixed to this shaft 233 in the vicinity of front and rear end portions thereof. A timing belt 235 is wound around each of the upper and lower pulleys 232. Each of the pickup front side plate 222 and the pickup deep side plate 223 is attached to the timing belt 235. An upper end of the shaft 233 is connected to the driving shaft of a PB unit drive motor 225. In accordance with such a structure, a vertical position of the paper feeding unit 250 can be controlled by controlling rotation of the shaft 233 by an operation of the PB unit drive motor 225.

Figure 14A:
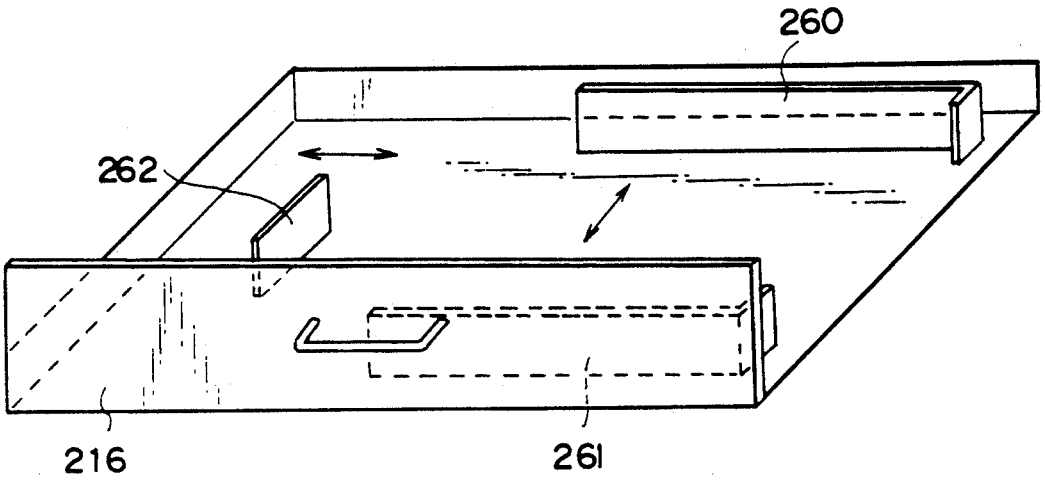
FIG. 14*a* is a perspective view showing one of paper feeding trays except for a lowermost paper feeding tray in the above multistage paper feeding/conveying apparatus.

As shown in FIG. 10, tray opening/closing sensors 251 to 254 are respectively disposed within the paper bank to detect opening and closing states of the paper feeding trays 216 to 219. FIG. 14*a* shows the third to fifth trays 216 to 218. Each of L-shaped side fences 260 and 261 is bent inward at a front end thereof. These side fences 260, 261 and an end fence 262 are attached to a bottom plate of each of the trays such that these fences can be moved in respective arrow directions in FIG. 14*a*. The four sides of sheets of paper can be guided by fixing these fences in positions according to paper sheet sizes.

Figure 14B:
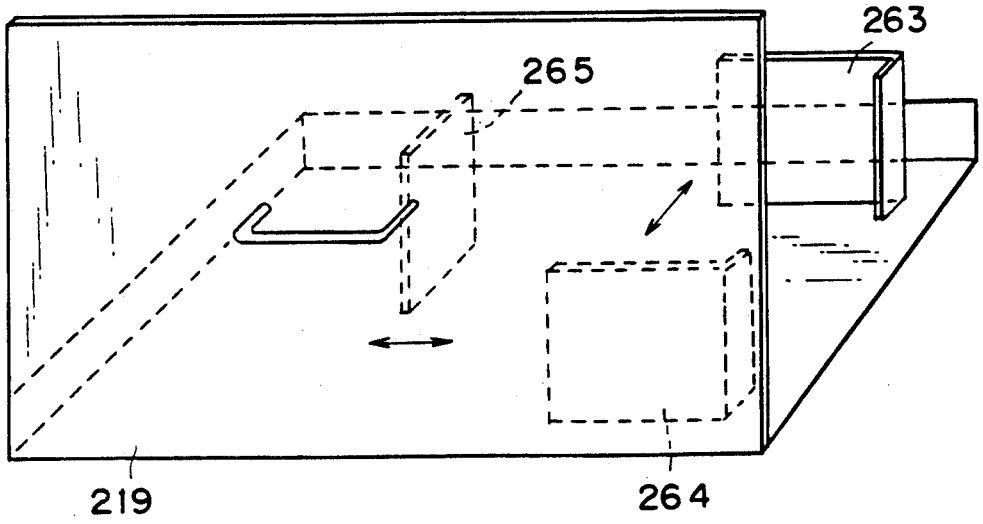
FIG. 14*b* is a perspective view showing the lowermost paper feeding tray.

FIG. 14*b* shows the sixth tray 219. Side fences 263, 264 and an end fence 265 have shapes respectively similar to those of the side fences 260, 261 and the end fence 262 with respect to each of the three trays 216 to 218. The side fences 263, 264 and the end fence 265 are attached to a bottom plate of the tray 219 such that these fences 263, 264 and 265 can be moved in respective arrow directions in FIG. 14*b*. The four sides of sheets of paper can be guided by fixing these fences in positions according to paper sheet sizes. A grip is disposed in each of the trays to pull each of the trays out of the housing on this side and push each of the trays into the housing so as to supply the sheets of paper into each of the trays.

III. An electric system of the multistage paper feeding/conveying apparatus will next be explained.

Figure 15:
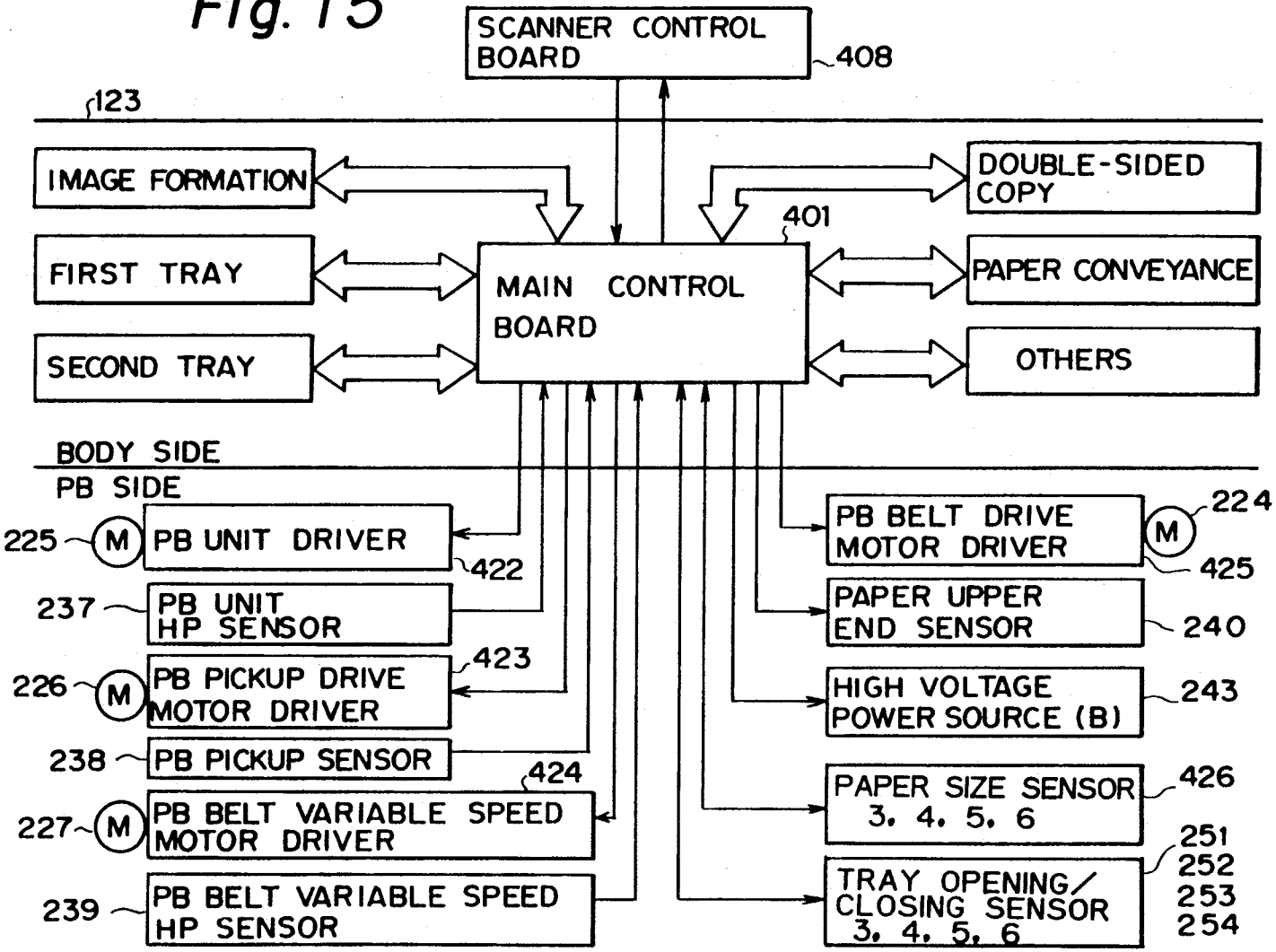
FIG. 15 is an electrical block diagram of an entire flexible feeding system disposed in the above copying system.

FIG. 15 is an electrical block diagram of an entire flexible feeding system (FFS) disposed in this copying system.

In FIG. 15, the interior of a main control board 401 is constructed by CPU, ROM, RAM, a timer, I/O ports, a serial electric circuit, etc. The interior of the main control board 401 may be constructed by a one-chip CPU including functions of these constructional elements. The main control board 401 controls sequential operations of the entire flexible feeding system (FFS). The flexible feeding system is generally divided into upper and lower sections on a body side and a paper bank side, respectively.

The upper section of the flexible feeding system on the body side thereof is generally divided into constructional portions relative to image formation, the first tray, the second tray, a double-sided copy, paper conveyance, and others in accordance with function.

In FIG. 15, reference numeral 123 designates a scanner section. A scanner control board 408 transfers and commands data of a read image and receives and transmits this data. The body side of the flexible feeding system and the scanner section do not directly relate to the features of the present invention. Therefore, descriptions about this body side and the scanner section are omitted in the following description.

An electric system of the flexible feeding system on the paper bank (PB) side will next be described.

In FIG. 15, reference numerals 224 and 425 respectively designate a PB belt drive motor and a driver thereof for conveying a sheet of transfer paper onto the body side of the flexible feeding system. In this embodiment, the PB belt drive motor 224 is constructed by a stepping motor.

Reference numerals 225 and 422 respectively designate a PB unit drive motor and a drive thereof for moving the paper feeding unit upward and downward. A vertical position of the paper feeding unit is controlled on the basis of the operation of a PB unit sensor 237 as a reference. Reference numeral 226 and 423 respectively designate a PB pickup motor and a driver thereof for performing a pickup operation of the sheet of transfer paper by using a stepping motor. A PB pickup sensor 238 constitutes a reference sensor for controlling a position of the sheet of transfer paper.

Reference numerals 227 and 424 respectively designate a PB belt variable speed motor and a driver thereof for temporarily stopping a movement of the PB belt to adsorb and hold the sheet of transfer paper. A PB belt variable speed HP sensor 239 detects a reference position of the PB belt.

A paper sheet upper end sensor 240 detects the position of an upper end of the sheet of transfer paper.

Reference numeral 243 designates a high voltage power source (B) similar to the above-mentioned high voltage power source and adsorbing the sheet of transfer paper.

A paper size sensor 426 detects a size of the sheet of paper on each of the third to sixth trays. Tray opening/-closing sensors 251 to 254 detect opening and closing states of each of the trays.

IV. An operating display section will next be described.

Figure 16:
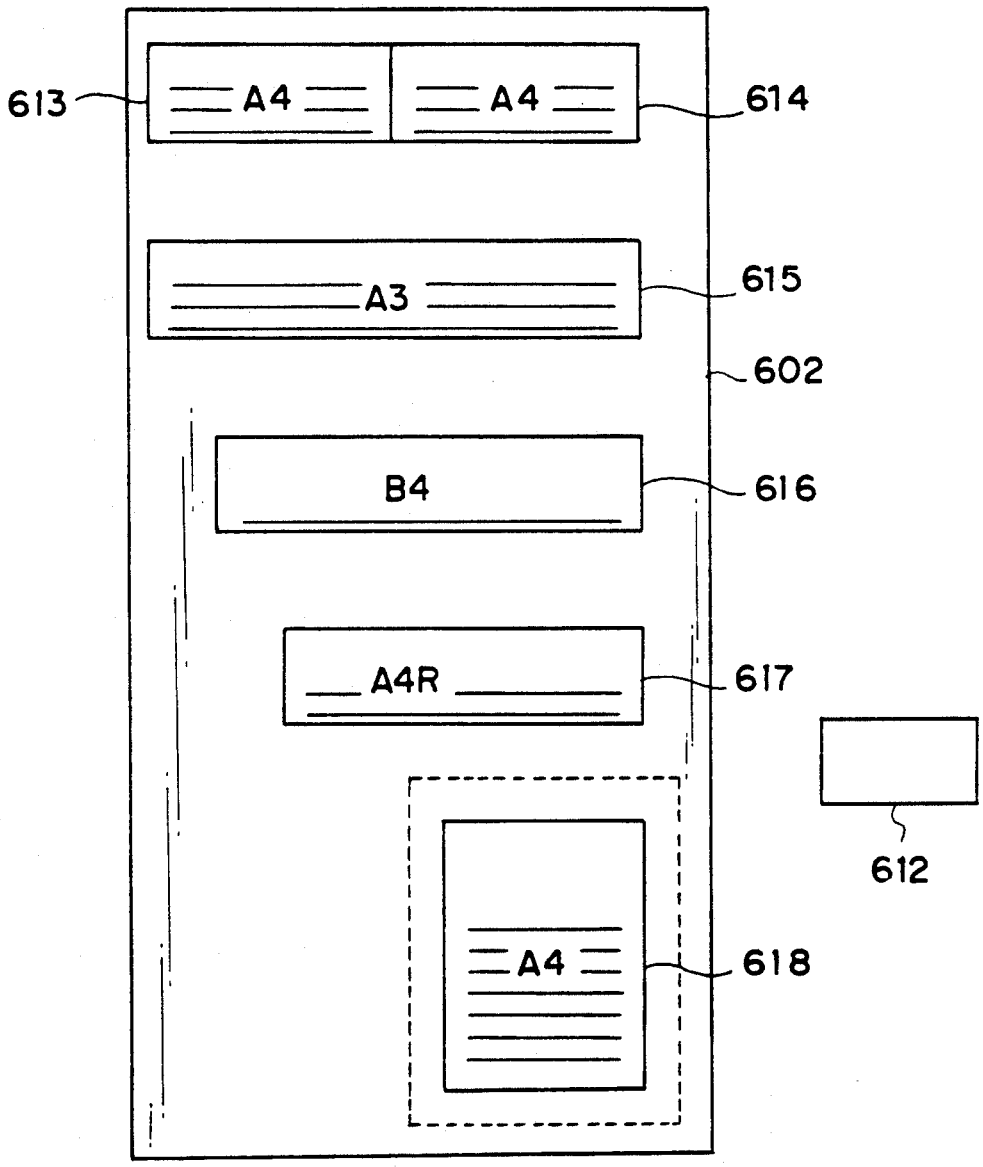
FIG. 16 is a plan view showing one example of a section for displaying paper sizes of the paper feeding trays.

The size and the remaining amount of paper sheets stored in each of the paper feeding trays within the paper bank are displayed by a paper display section 602 of a liquid crystal display (LCD) within an operation panel disposed in the body of the image forming apparatus. FIG. 16 shows one example of this paper display section. In this example, in the paper display section 602, indicators 613 to 618 respectively display the size and the remaining amount of paper sheets stored in each of the paper feeding trays including two paper feeding trays arranged within the body of the image forming apparatus.

As described later, the remaining amount of paper sheets is judged by the number of pulses counted until the paper sheet upper end sensor 240 of the paper feeding unit 250 detects the upper end of the sheets of paper within each of the paper feeding trays from a home position of the PB belt drive motor 224.

In the example shown in FIG. 16, paper size A4 of the sixth paper feeding tray is selected. A tray for feeding the sheet of paper is sequentially selected by a key input of a paper selecting key 612. The selected tray is displayed by the paper display section 602.

V. An operation of the paper bank will next be described.

The operation of the paper bank having the above-mentioned construction will next be described in detail.

<The paper feeding unit is vertically moved as follows.>

When opening and closing operations of each of the trays are detected by the opening/closing sensors 251 to 254, sheets of paper are assumed to be supplied to each of the trays so that the following initial operation is performed.

The multistage paper feeding/conveying apparatus has four fixed paper feeding trays and one movable paper feeding unit 250. When a paper feeding position is changed in accordance with the remaining amount of paper sheets, this paper feeding position is memorized or stored to a memory device and a position of each of the paper feeding trays can be changed at a high speed.

When the opening and closing operations of the third to sixth paper feeding trays 216 to 219 are respectively detected and a certain paper feeding tray is first selected, the paper feeding unit 250 is vertically moved by the PB unit drive motor 226 to an uppermost point of this paper feeding tray. The uppermost point of each of the trays is located by about 5 mm above an upper face of the paper sheets when 250 sheets of paper as a maximum loading capacity are stored in each of the third to fifth paper feeding trays 216 to 218, or 2000 sheets of paper as a maximum loading capacity are stored in the sixth paper feeding tray 219. The uppermost point of each of the third to fifth paper feeding trays is located by 30 mm above a bottom plate thereof. The uppermost point of the sixth paper feeding tray is located by 205 mm above a bottom plate thereof. The uppermost point of each of the paper feeding trays is set as a home position thereof.

A vertical home position of the paper feeding unit 250 is equal to that of the third paper feeding tray 216 located at an uppermost stage. The vertical position of the paper feeding unit 250 is controlled by the drive or stepping motor 224 such that the paper feeding unit 250 is moved from the vertical home position thereof in a downward direction in accordance with the number of step pulses of the stepping motor. At this time, a vertical moving speed of the paper feeding unit 250 is set to 150 mm/sec and the paper feeding unit 250 is moved upward or downward in accordance with normal or reverse rotation of the stepping motor. The paper feeding unit 250 is lowered from the home position of each of the paper feeding trays until an upper end of the sheets of paper is detected by the paper sheet upper end sensor 240 disposed in the paper feeding unit 250. A paper feeding belt is stopped in a position separated by 5 mm from the detected upper end of the sheets of paper. A paper feeding operation is repeatedly performed with this position as a home position of this paper feeding operation.

When each of the paper feeding trays is selected and a sheet of paper is once fed, information of the paper feeding position of the paper feeding unit 250 is stored at any time to a non-volatile RAM within the main control board 401 as an amount indicative of the number of pulses counted from the home position of the stepping motor even when the selected paper feeding tray is changed. Thus, it is possible to judge the remaining amount of sheets of paper stored in each of the paper feeding trays. This paper feeding position of the paper feeding unit 250 is set to an initial position for starting the next paper feeding operation thereof.

When each of the paper feeding trays is selected again, the paper feeding unit 250 is directly moved to a position detected by the paper sheet upper end sensor which is attached to the paper feeding unit 250 and is located by 5 mm above the stored sheets of paper below the home position of the selected tray. The paper feeding operation is repeatedly performed with this position as a home position of the paper feeding operation. Thus, the paper feeding trays are rapidly changed even when the remaining amount of sheets of paper is small.

When no sheet of paper is detected by the paper sheet upper end sensor 240 in the home position of the paper feeding operation during a continuous paper feeding operation, the paper feeding unit 250 is moved by the PB unit drive motor 225 to a downward position until the sheet of paper is detected by the paper sheet upper end sensor 240. Then, the paper feeding operation is repeatedly performed. Thereafter, the sheet of paper is repeatedly fed from a fixed paper feeding tray while the paper feeding unit 250 is lowered as the paper feeding operation is performed.

An error in operation of the above non-volatile RAM is prevented by initializing stored data thereof by the paper feeding operation of each of the paper feeding trays and attaching and detaching operations thereof.

<The selection of a fed sheet of paper will next be described.>

Figure 17:
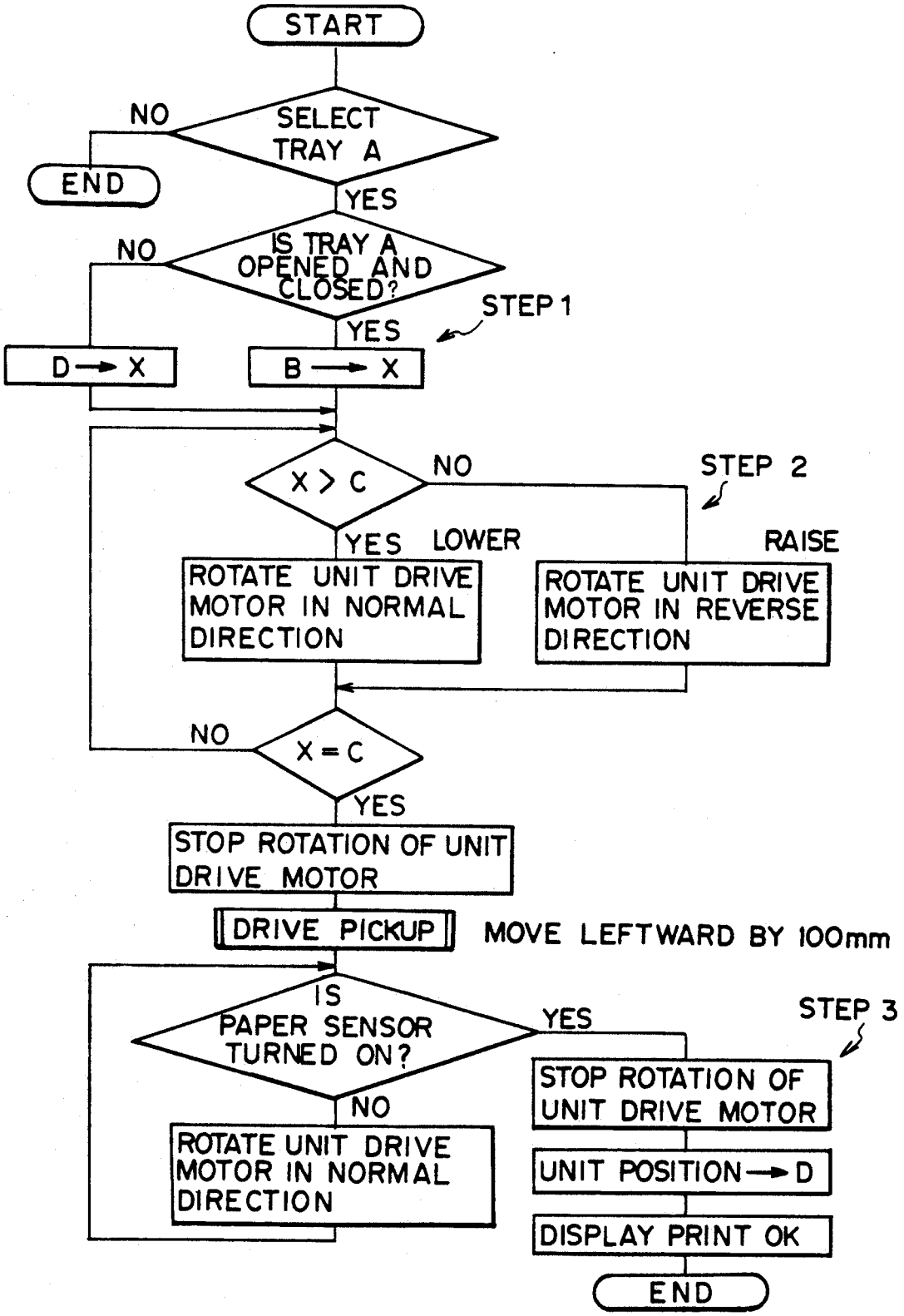
FIG. 17 is a flow chart showing a fed paper selecting operation.

In FIG. 17, reference numeral A designates the third to sixth paper feeding trays. Reference numeral B designates an initial position of each of the paper feeding trays. Reference numeral C designates the present position of the paper feeding unit. Reference numeral D designates a paper feeding home position of each of the paper feeding trays. Reference numeral X designates a target position of the paper feeding unit in a vertical movement thereof.

A selecting operation of the fed sheet of paper is shown in a flow chart in FIG. 17. When a certain paper feeding tray is selected in accordance with the selection of a paper size, it is judged in a STEP 1 whether or not it is a first paper feeding operation after this selected tray is opened and closed. In the case of the first paper feeding operation, the remaining amount of sheets of paper is unknown so that a paper feeding position is undetermined. After a second paper feeding operation, a loading amount of the sheets of paper is already known in an uppermost position B of each of the above trays. Accordingly, a preceding final paper feeding home position D is set to a target position X of the paper feeding unit 250 and is compared with the present position of the paper feeding unit 250. Then, the paper feeding unit 250 is vertically moved in a STEP 2. To vertically move the paper feeding unit 250, a pickup roller 208 is already located in an innermost home position in a moving range of the paper feeding unit 250.

When the paper feeding unit 250 reaches the target position, the pickup roller 208 is moved in a paper feeding direction to perform the paper feeding operation. Next, in a STEP 3, an upper end of the sheets of paper is detected by the paper sheet upper end sensor 240 and the paper feeding unit 250 is lowered such that this paper feeding unit is moved to the paper feeding home position. After the second paper feeding operation, the paper feeding unit 250 has already reached the preceding final paper feeding home position D so that this lowering movement of the paper feeding unit is not performed. At this time, the paper feeding home position is stored to a buffer memory D to use this position in the paper feeding operation.

When the paper feeding unit 250 has reached the paper feeding home position, a display section for displaying the ability of a printing operation is turned on to show a state in which the printing operation can be performed. Further, a copying operation is also started. Thereafter, the above-mentioned processings in the STEP 3 are repeatedly performed during the paper feeding operation. The position of the paper feeding unit 250 is stored to the buffer memory D while this paper feeding unit 250 is lowered.

<The pickup roller is moved leftward and rightward as follows.>

The pickup roller 208 of the paper feeding unit 250 is displaced by 100 mm in the paper feeding direction together with the PB belt 201 to adsorb a sheet of paper within a tray to the PB belt 201 at a paper feeding time. When the paper feeding unit 250 is vertically moved by the selection of a paper size, the pickup roller 208 is moved to a rightward home position to perform an escaping operation thereof. The pickup roller 208 is moved from the home position detected by the PB pickup sensor 238 by an operation of the PB pickup drive motor 226 attached to the paper feeding unit 250. A position of the PB pickup drive motor 226 is controlled by the operation of a stepping motor in accordance with the number of pulses thereof.

<A distance between sheets of paper will next be described.>

In the paper bank 200, a sheet of paper is fed from a fixed paper feeding tray by the paper feeding unit 250 movable in the vertical direction. Accordingly, paper feeding positions are different from each other in accordance with a selected paper feeding tray and a loading amount of the paper sheets thereof. A timing for conveying the sheet of paper to a body of the multistage paper feeding/conveying apparatus is calculated from a paper feeding timing of the paper feeding unit 250 as follows. The PB belt 201 is moved by the PB belt drive motor 224 composed of a stepping motor at an equal speed of 130 mm/sec. After the PB belt variable speed motor 227 is operated, the sheet of paper is conveyed at a speed of 130 mm/sec. A conveying distance of the paper sheet is changed in accordance with a vertical position of the paper feeding unit and is determined by the number N of steps of the PB unit drive motor 225 counted from the home position thereof. The sheet of paper is moved by 0.2 mm in one step of the PB unit drive motor 225. Accordingly, a conveying passage distance L with respect to each of the trays is represented as follows.

$$L=N\times 0.2+P.$$

In this formula, reference numeral P designates a fixed distance in accordance with each of the paper feeding trays. For example, the fixed distance P is set to 200 mm in the cases of the third to fifth paper feeding trays and is set to 120 mm in the case of the sixth paper feeding tray. This difference in distance is based on the conveying distance in a horizontal direction. Accordingly, a conveying time T is provided as follows.

$T=L/130$.

A total of this conveying time T and a paper feeding time is equal to a time required to feed a first sheet of paper. A time required to continuously feed a second or subsequent sheet of paper does not relate to this conveying time T. It is sufficient to repeatedly perform the continuous paper feeding operation in a state in which the distance between sheets of paper is constant. In the case of paper size A4, the paper feeding operation is repeatedly performed in 3 seconds/cycle so that a printing operation of 20 PPM can be performed.

<The paper feeding operation will next be described.>

The paper feeding operation will be explained with reference to FIGS. 18*a* to 18*c* and FIGS. 19*a* to 19*c*. In this embodiment, a mechanism for reducing and stopping the movement of the PB belt 201 is constructed by using the two belt variable speed rollers 209 and 210.

Figure 18A:
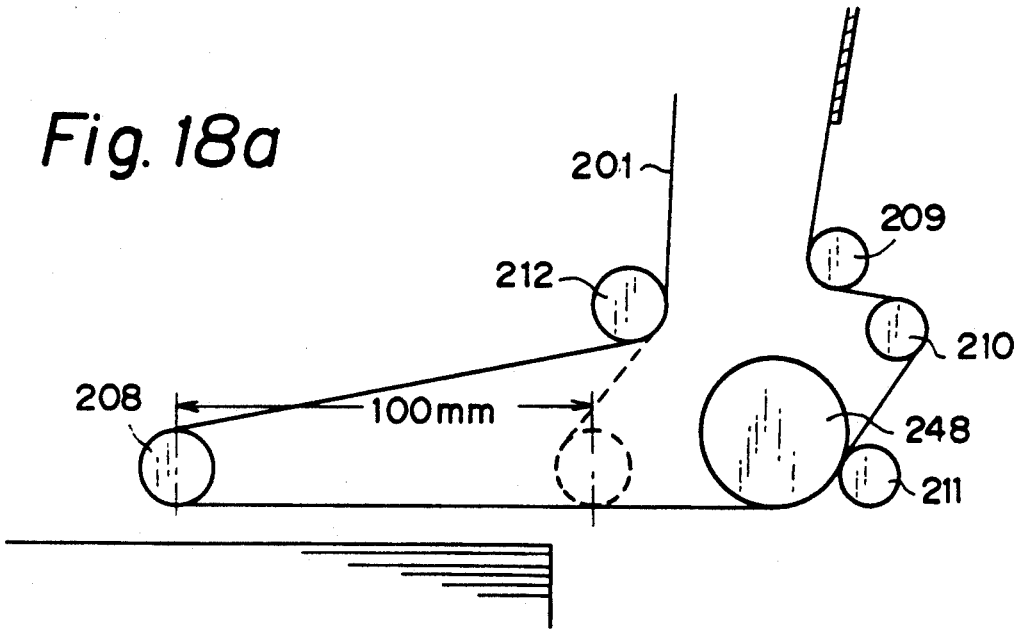
FIGS. 18*a*, 18*b* and 18*c* are views showing and explaining changes in feeding operation of a sheet of paper fed from the paper feeding trays except for the lowermost paper feeding tray.
Figure 18B:
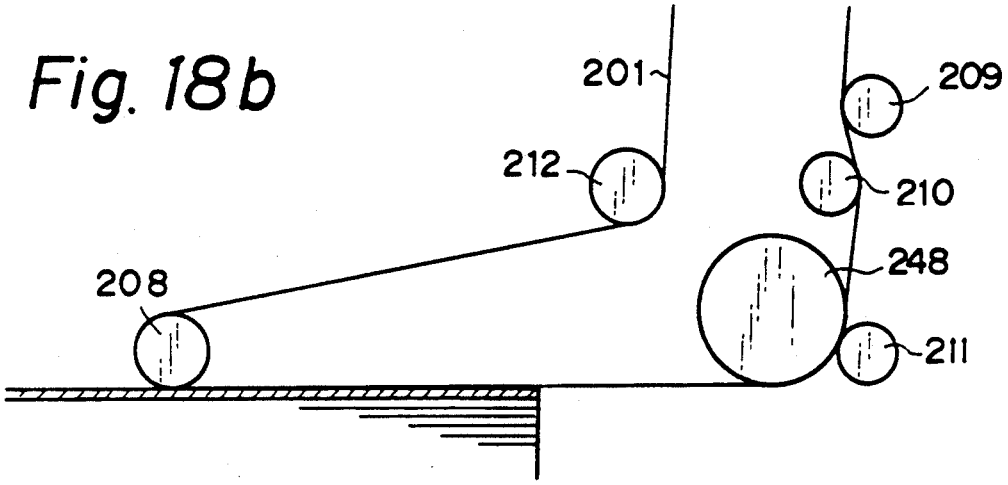
Figure 18C:
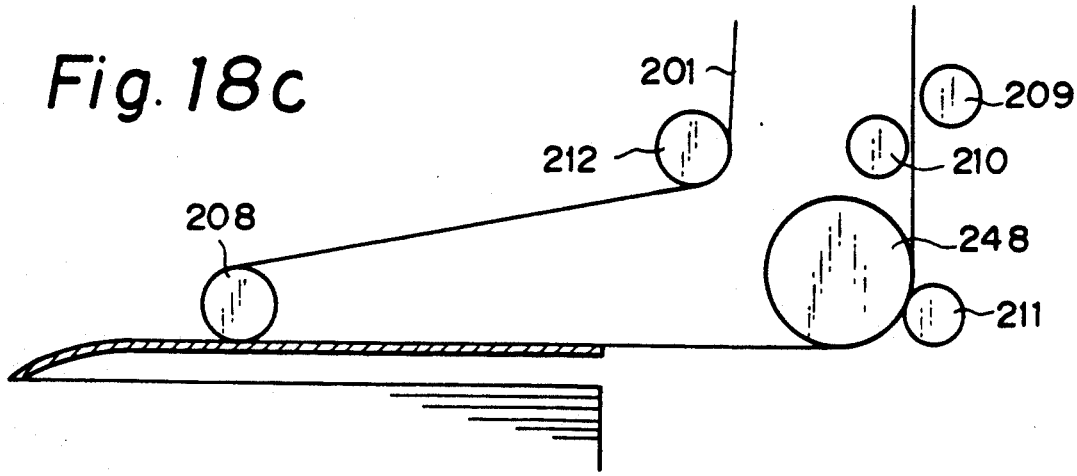
Figure 19A:
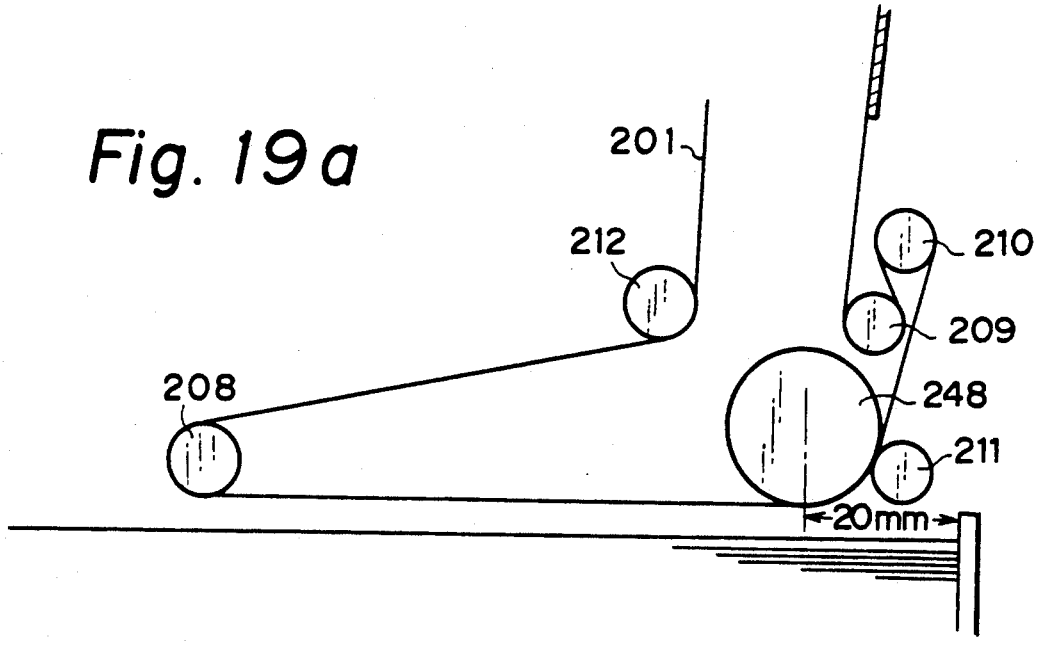
FIGS. 19*a*, 19*b* and 19*c* are views showing and explaining changes in feeding operation of a sheet of paper fed from the lowermost paper feeding tray.
Figure 19B:
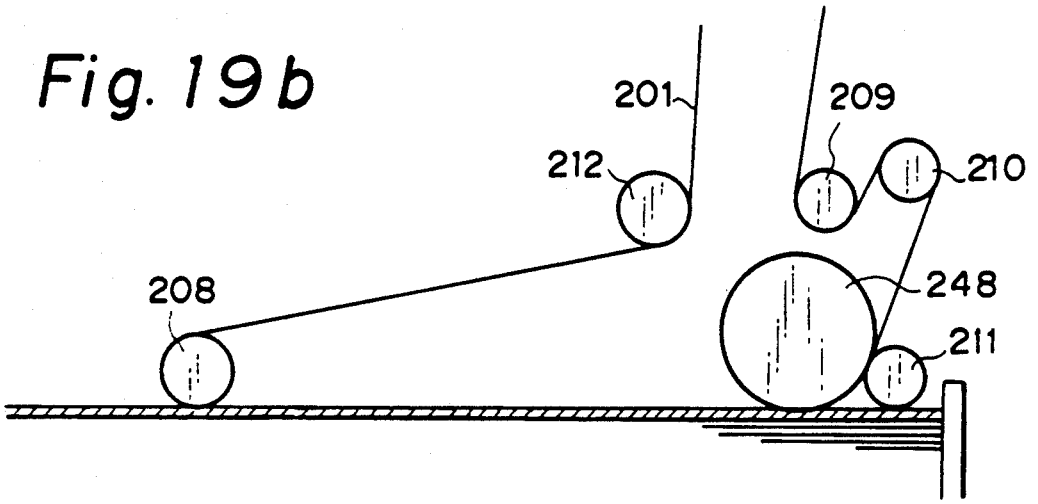
Figure 19C:
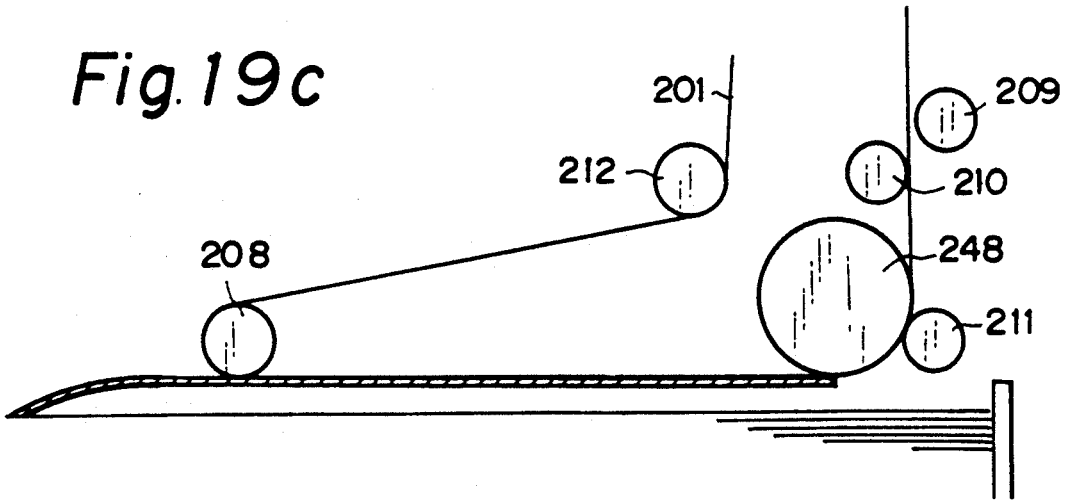

FIGS. 18*a* to 18*c* show a case in which the sheet of paper is fed from the third to fifth paper feeding trays 216 to 218. FIGS. 19*a* to 19*c* show a case in which the sheet of paper is fed from the sixth paper feeding tray 219.

As a home position of the paper feeding position, the paper feeding unit 250 sets a position detected by the paper sheet upper end sensor which is attached to the paper feeding unit 250 and is located by 5 mm above an upper face of sheets of paper stored in a paper feeding tray below a home position thereof. The paper feeding operation is repeatedly performed with this position detected by the paper sheet upper end sensor as the home position of the paper feeding position. At this time, a flat portion of the PB belt 201 arranged between the pickup roller 208 and the roller 248 is located by 5 mm above the upper end of the sheets of paper. Next, the pickup roller 208 displaces the PB belt 201 by 100 mm from the home position thereof in the paper feeding direction to adsorb a sheet of paper within the paper feeding tray to the PB belt 201 at the paper feeding time.

Before the paper feeding operation, an electric charge pattern is formed by the roller 212 on the PB belt 201 by a length amount corresponding to the paper size in synchronization with paper feeding timing so as to adsorb an uppermost sheet of paper in the tray to the PB belt 201.

The paper feeding unit 250 is then lowered by 5 mm to make the PB belt 201 come in contact with an upper end portion of the paper sheet. At this time, the paper feeding unit is operated by using the above-mentioned belt speed changing mechanism such that a displacing speed of the PB belt 201 on a paper contact face thereof is equal to zero. An operation of the belt speed changing mechanism will be described in detail later. The displacing speed of the PB belt 201 is set to zero to improve adsorption of the sheet of paper since only the uppermost sheet of paper is adsorbed and conveyed from the sheets of paper at rest. However, the sheet of paper comes in contact with the PB belt 201 and may be adsorbed and conveyed by this belt in a state in which the conveying speed of the PB belt 201 is reduced and set to a speed equal to or lower than 130 mm/sec.

The sheet of paper is adsorbed to the PB belt from a front end thereof when the sheet of paper is fed from each of the third to fifth paper feeding trays 216 to 218. The sheet of paper is conveyed in a horizontal direction until the roller 248. Accordingly, the paper feeding unit 250 is raised by using the belt speed changing mechanism to the home position of the paper feeding operation located by 5 mm above an upper face of the sheets of paper in a state in which a relative displacing speed of the PB belt 201 on the paper contact face with respect to the tray is equal to zero.

After a conveying path of the sheet of paper having an S-shaped curve is changed to an original conveying path having no S-shaped curve by an operation of the belt speed changing mechanism, a vertical conveying section of the PB belt 201 is changed and formed in the shape of a straight line. Accordingly, the sheet of paper is adsorbed to the PB belt 201 moved by the PB belt drive motor 224 at the equal speed of 130 mm/sec and is conveyed at a predetermined equal speed.

A winding means of the belt speed changing mechanism is then operated between conveyed sheets of paper continuously fed and passing through the belt speed changing mechanism, thereby preparing a speed reducing operation in the next paper feeding process. At this time, the conveying speed of the PB belt 201 is accelerated between the rollers 208 and 248 in the paper feeding section. However, at this time, no PB belt comes in contact with the sheet of paper so that no problem about the belt is caused.

When the sheet of paper is fed from the sixth tray 219, the sheet of paper is adsorbed to the belt from a position separated about 20 mm from a front end of the sheet of paper. The sheet of paper is first conveyed by using the belt speed changing mechanism in a horizontal leftward direction to convey the sheet of paper by the roller 248 in the vertical direction. Namely, the paper feeding unit 250 is raised to the home position of the paper feeding operation located by 5 mm above the sheets of paper while the relative displacing speed of the PB belt 201 on the paper contact face with respect to the tray is set to a minus speed. Thus, the sheet of paper can be also adsorbed to the PB belt 201 until the front end of the paper sheet in the case of the sixth paper feeding tray, thereby stably feeding and conveying the sheet of paper.

<A belt speed charging operation of the paper feeding section will next be described.>

A speed changing operation using the two belt variable speed rollers 209 and 210 shown in FIGS. 18 and 19 will first be explained.

Figure 20:
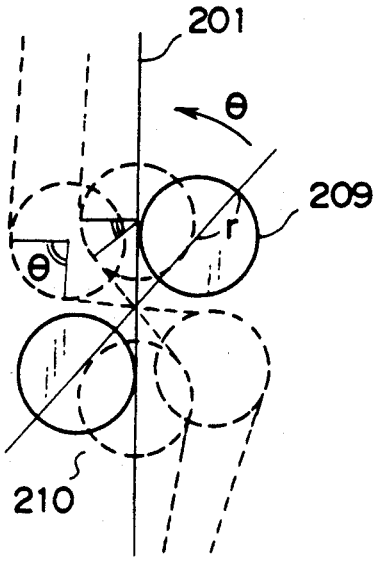
FIG. 20 is a view for explaining the operation of a belt variable speed roller disposed in a paper feeding section.

Each of the two belt variable speed rollers 209 and 210 has a diameter of 8 mm. A distance between centers of the belt variable speed rollers 209 and 210 is set to 12 mm. The PB belt 201 is wound around central portions of the belt variable speed rollers 209 and 210 by an operation of the PB belt variable speed motor 227 and is unwound therefrom by the operation of the PB belt variable speed motor 227. FIG. 20 shows such winding and unwinding operations of the PB belt 201. Accordingly, when no PB belt is conveyed, a belt moving amount l is approximately provided by the following formula when an angle of rotation of each of the belt variable speed rollers 209 and 210 is set to $\theta$ (rad).

$$l=2r\theta+12(1-\cos\theta).$$

A displacing speed v is represented as follows by differentiating this belt moving amount with respect to time using the relation of $\theta=\omega$ t.

$$v=2r\omega+12\omega\sin\omega t.$$

In this case, reference numeral ω designates an angular velocity of rotation of each of the belt variable speed rollers 209 and 210. Reference numeral r designates a winding radius of each of the belt variable speed rollers 209 and 210.

The PB belt 201 is moved at the speed of 130 mm/sec and the paper feeding unit 250 is lowered at a speed of 150 mm/sec. At this time, the PB belt 201 is moved at a speed of 280 mm/sec on a contact face of the fed sheet of paper. If the displacing speed v is set to 280 mm/sec such that the speed 280 mm/sec of the PB belt is canceled by this displacing speed to stop the PB belt 201 on the paper contact face, time t and the angular velocity ω in a position of rotation of each of the belt variable speed rollers are calculated from the above formula. Namely, a rotational speed of the PB belt variable speed motor 228 is provided from the above formula.

When the sheet of paper is fed from the sixth tray 219, a time for displacing the PB belt 201 by 20 mm on the paper contact face in a minus displacing direction is provided as follows while the paper feeding unit 250 is raised to the home position of the paper feeding operation located by 5 mm above the upper face of the paper sheets.

$$5\ (\text{mm})/150\ (\text{mm/sec.})=0.033\ (\text{sec.}).$$

At this time, a reverse linear velocity of the PB belt is provided as follows.

$$20\ \text{mm}/0.033\ \text{sec.}=600\ \text{mm/sec.}$$

The PB belt 201 is moved at the equal speed of 130 mm/sec. When the paper feeding unit 250 is raised at the speed of 150 mm/sec, the displacing speed v is set to 580 mm/sec calculated as follows so as to unwind the PB belt 201 at a speed of 580 mm/sec on the contact face of the fed sheet of paper.

$$600+130-150=580\ \text{mm/sec.}$$

The above displacing time and the above reverse linear velocity are similarly provided from this displacing speed.

The PB belt variable speed motor 228 is constructed by a stepping motor. A timer value corresponding to the rotational speed of the PB belt variable speed motor 228 at the above calculated displacing time is stored to a ROM disposed within the main control board 410 in advance. Speed and rotation of the PB belt variable speed motor 228 in normal and reverse directions thereof are controlled while this timer value is called from the ROM.

To reduce the moving speed of the PB belt in the next paper feeding process, the winding operation of the belt speed changing mechanism may be performed at an equal rotational speed of the PB belt variable speed motor 228 between conveyed sheets of paper continuously fed and passing through the belt speed changing mechanism since the distance between the sheets of paper is normally set to about 150 mm in the case of paper size A4.

The belt speed changing mechanism having another structure will next be described with reference to FIGS. 21 and 22.

This speed changing mechanism uses two fixed rollers 650, 651 and one displacing roller 652.

Figure 21:
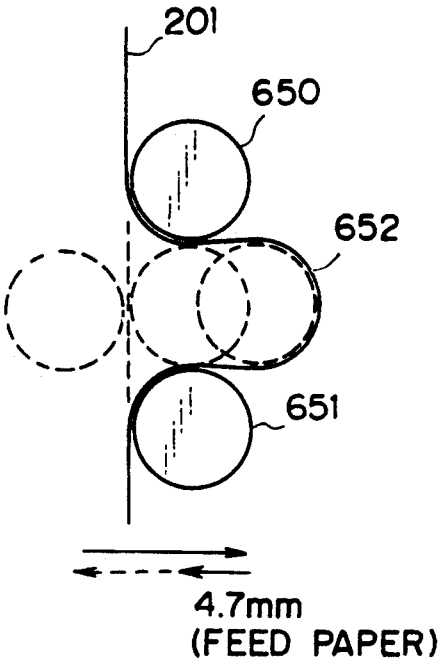
FIGS. 21 and 22 are views for explaining the operation of a belt speed changing mechanism having a structure different from that of the belt variable speed roller.

FIG. 21 shows a case in which a sheet of paper is fed from the third to fifth trays 216 to 218. FIG. 22 shows a case in which the sheet of paper is fed from the sixth tray 219. Movements of a paper feeding face of the PB belt 201 and the sheet of paper are similar to those shown in FIGS. 18 and 19.

The displacing roller 652 is horizontally moved by the PB belt variable speed motor 227 between the two fixed rollers 650 and 651 to displace the PB belt 201. Thus, a moving speed of the PB belt 201 on the paper feeding face thereof is adjusted.

A time for lowering the paper feeding unit 250 by a distance of 5 mm at the speed of 150 mm/sec is provided as follows.

$$5\ \text{mm}/150\ \text{mm/sec.}=0.033\ \text{sec.}$$

The PB belt displaces the displacing roller 652 at a speed of 280 mm/sec in a minus displacing direction so as to cancel the movement of the PB belt at the equal speed and a displacement of the paper feeding face displaced at a speed of 150 mm/sec and caused by lowering the paper feeding unit 250. This displacing operation of the PB belt is performed for a time of 0.033 seconds and a displacing amount at this time is provided as follows.

$$280\ \text{mm/sec.}\times 0.033\ \text{sec.}=9.3\ \text{mm.}$$

Accordingly, it is sufficient to set a displacing speed of the displacing roller 652 as follows.

$$280\ (\text{mm/sec.})/2=140\ (\text{mm/sec.}).$$

Further, a displacing amount of the displacing roller 652 is set as follows.

$$9.3\ \text{mm}/2=4.7\ \text{mm.}$$

It is sufficient to move the displacing roller 652 leftward at the equal displacing speed.

Similarly, in a displacement of the PB belt in the minus displacing direction at a paper feeding time of the sixth tray 219, the displacing roller 652 is moved leftward at an equal speed in a state in which the displacing speed of this displacing roller 652 is set to 290 mm/sec and the displacing amount thereof is set to 9.7 mm.

A speed changing operation of the PB belt is performed by equal speed control in a state in which a total displacing amount of the displacing roller 652 is set to 14.4 mm when axes of the fixed rollers 650 and 651 are located rightward from an axis of the displacing roller 652.

<Paper feeding timing will next be described.>

Figure 22:
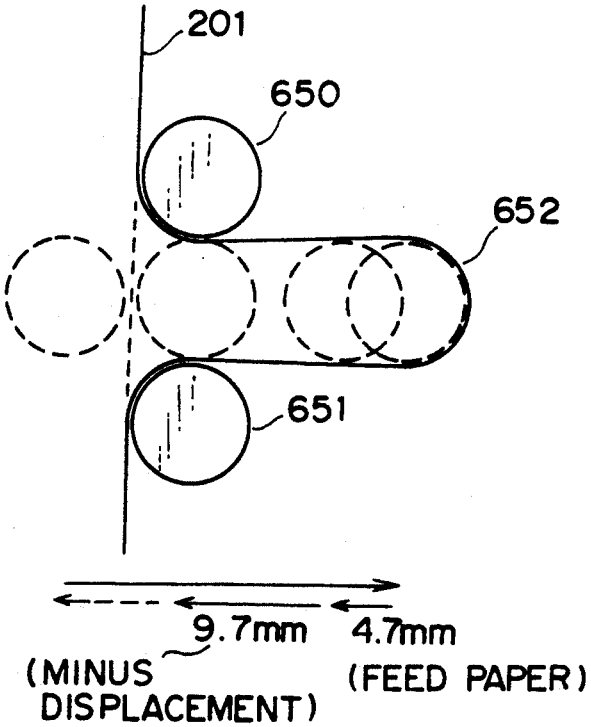
Figure 23:
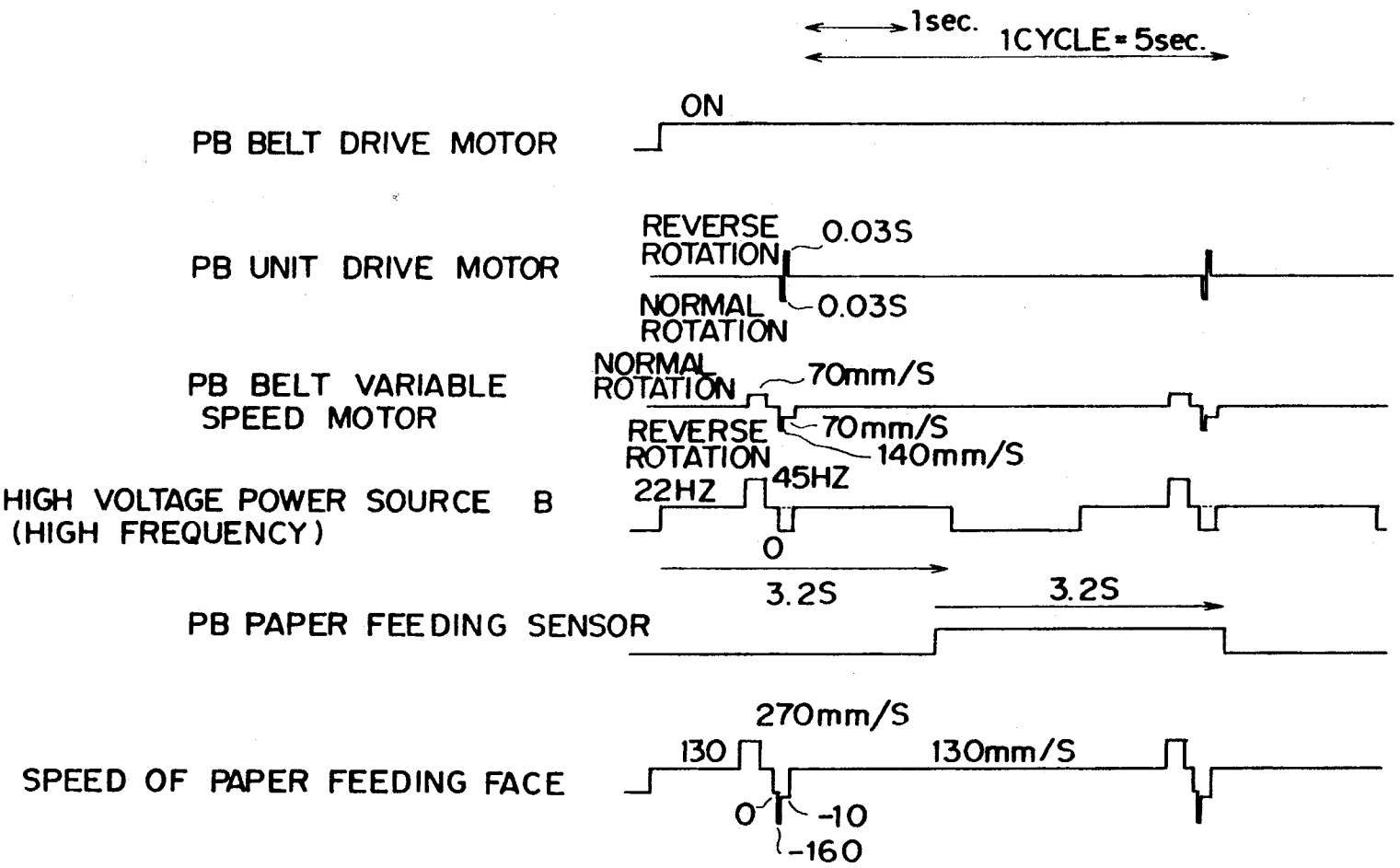
FIGS. 23 and 24 are timing charts showing a series of operating timings of respective constructional devices in the multistage paper feeding/conveying apparatus at a paper feeding time thereof.
Figure 24:
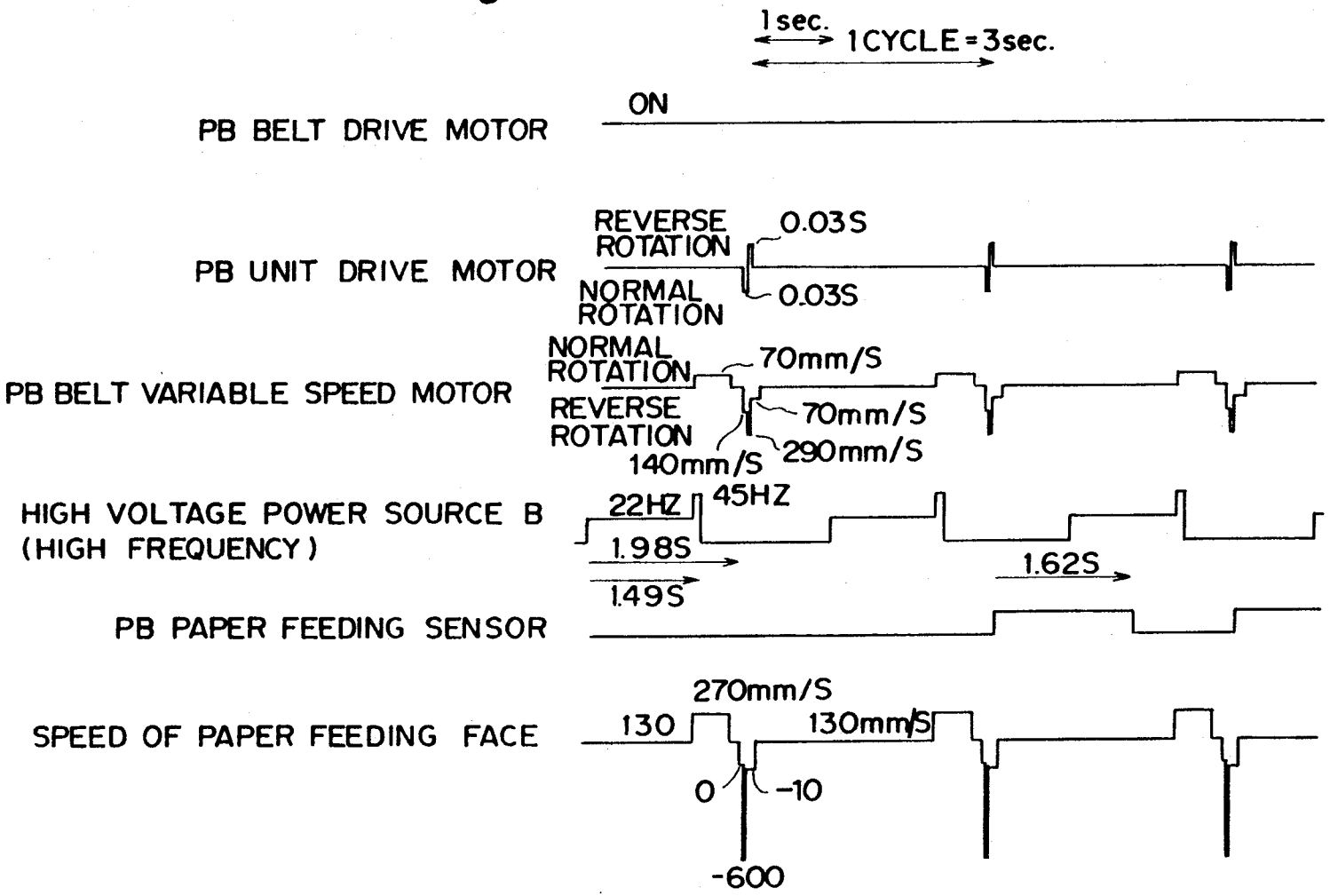

Paper feeding time will first be explained when a speed change gear having each of the structures shown in FIGS. 21 and 22 is used. FIG. 23 shows an example of a control timing chart of the paper feeding operation when a sheet of paper having size A3 is continuously fed from the third paper feeding tray. In FIG. 23, a distance between a bias roller and a rear end of the sheet of paper is set to 220 mm and the length of a conveying path is set to 200 mm. FIG. 24 shows an example of a control timing chart of the paper feeding operation when the sheet of paper having size A4 is transversally arranged and is continuously fed from the sixth paper feeding tray. In FIG. 24, a distance between a bias roller and a rear end of the sheet of paper is set to 320 mm and the length of a conveying path is set to 350 mm.

In FIG. 23, the PB belt drive motor 224 is turned on to rotate this motor at an equal speed. Next, the high voltage power source 243 is operated in synchronization with paper feeding timing. With respect to this paper feeding timing for start, a time value calculated from a linear velocity of the forming position of an electric charge pattern of the PB belt 201 is programmed in advance to form the electric charge pattern on the upstream side of a paper feeding section in a position of the PB belt 201 for adsorbing a sheet of paper thereto. In this embodiment, this time value is equal to a time set by about 1.48 seconds before the adsorbing operation of the paper sheet. This time value is similarly set when the sheet of paper is fed from each of the fourth and fifth paper feeding trays. However, a time value in the case of the paper feeding operation using the sixth paper feeding tray is different from that in the case of each of the third to fifth trays.

Next, before the paper feeding operation, the PB belt variable speed motor 227 is rotated in the normal direction to set a standby state of the displacing roller 652 in a rightward direction thereof. The PB unit drive motor 225 is then rotated in the normal direction at the paper feeding timing and the PB belt variable speed motor 227 is simultaneously rotated in the reverse direction at a high speed. Thus, the moving speed of the PB belt 201 on an adsorbing face of the fed sheet is set to zero to make the PB belt 201 come in contact with an upper face of the paper sheet. Further, the PB belt variable speed motor 227 is rotated in the reverse direction to escape the displacing roller 652 leftward, thereby vertically conveying the PB belt 201.

The fed and conveyed sheet of paper is detected for about 3.2 seconds by a PB paper feed sensor 51 disposed in a paper feeding path of the apparatus body. A completing timing of the operation of the high voltage power source 243 is equal to that in the case of an equal speed operation of the PB belt 201 since the PB belt 201 is accelerated and decelerated for a continuous operating period of the high voltage power source. Accordingly, the high voltage power source 243 is operated for a time period of 3.2 seconds. The PB variable speed motor 227 is operated when the forming position of the electric charge pattern is changed at the linear velocity of the PB belt 201. When the PB variable speed motor 227 is operated, a frequency of the electric charge pattern applied by the high voltage power source 243 is changed such that a period of the electric charge pattern of the PB belt 201 is constant. When the linear velocity of the PB belt 201 is equal to or lower than zero in the forming position of the electric charge pattern, an arbitrary operation of the high voltage power source 243 can be performed by effectively providing a finally formed electric charge pattern. In this embodiment, the high voltage power source 243 is turned off.

In FIG. 24, a basic operation of the multistage paper feeding/conveying apparatus is similar to that shown in FIG. 23. The paper feeding operation with respect to the sixth tray includes a displacing operation of the PB belt 201 on an adsorbing face thereof in a minus displacing direction. When the PB unit drive motor 225 is rotated in the reverse direction, the PB variable speed motor 227 is rotated in the reverse direction at a higher speed to provide a linear velocity of −600 mm/sec on the paper feeding face. Since the paper feeding trays are different from each other in accordance with layout, the high voltage power source 243 is operated before about 1.98 seconds with respect to the adsorbing operation. Since paper size A4 is used, the operation of the PB belt 201 is stopped in the forming position of the electric charge pattern during a high speed movement of this belt.

Thus, the sheet of paper can be adsorbed and conveyed by the PB belt 201 in the forming position of the electric charge pattern thereof having a length equal to the paper size in a state in which the operation of the PB belt 201 is stopped.

When the sheet of paper is thin and light in weight, it is possible to sufficiently convey the sheet of paper if the electric charge pattern is formed in a corresponding suitable front portion of the paper sheet in accordance with the weight of the paper sheet.

<The sheet of transfer paper is transmitted from the paper bank side to the apparatus body side as follows.>

The sheet of transfer paper can be smoothly transmitted from the paper bank side to the apparatus body side without any slack and tension by setting conveying speeds of a transfer belt and the PB belt to be equal to each other. Since a linear velocity of the transfer belt on the apparatus body side is set to 120 mm/s, the sheet of transfer paper can be smoothly transmitted by setting a linear velocity of the PB belt to 120 mm/s. However, in this embodiment, the linear velocity of the PB belt is set to 130 mm/s to improve productivity of the paper bank. In this case, the linear velocity of the PB belt is higher than that of the transfer belt (linear velocity of PB belt->linear velocity of transfer belt).

The speed of the transfer belt can be increased by a principle similar to that in the speed change gear shown in FIG. 21 by moving a moving roller 29 from the leftward direction to the rightward direction in FIG. 10 when the sheet of transfer paper is transmitted from the PB belt 201 to the transfer belt 32. The transfer belt and the sheet of transfer paper apparently come in contact with each other at a relative speed of zero. The sheet of transfer paper is then adsorbed and conveyed by the transfer belt in accordance with the electric charge pattern, thereby completing the transmitting operation of the sheet of transfer paper.

As mentioned above, in accordance with the present invention, a sheet of paper can be fed from selected one of paper feeding containers vertically arranged at multiple stages. This sheet of paper can be then conveyed by a single endless conveying belt wound around a single paper feeding unit and a vertical conveying path. Accordingly, there is no fear of generation of a paper jam, etc. so that a reliable multistage paper feeding/conveying apparatus can be obtained.

Further, copying productivity can be improved by setting a conveying speed of the sheet of paper to be higher than a reference conveying speed of an image forming apparatus.

Further, the generation of paper powder is restricted by approximately setting a relative speed of the endless conveying belt with respect to the paper sheet to zero in a paper feeding section at a paper feeding time. Accordingly, it is possible to prevent a defect in conveyance of the sheet of paper caused by the paper powder and a reduction in image quality at an image forming time.

Many widely different embodiments of the present invention may be constructed without departing from the spirit and scope of the present invention. It should be understood that the present invention is not limited to the specific embodiments described in the specification, except as defined in the appended claims.

What is claimed is:

1. A multistage paper feeding/conveying apparatus comprising:

a plurality of recording paper storing means vertically arranged at multiple stages;

paper feeding means for feeding a sheet of recording paper one by one from arbitrary one of the recording paper storing means; and vertical conveying means vertically extending and opposed to a paper feeding side of each of the recording paper storing means, the vertical conveying means conveying the sheet of recording paper fed from said paper feeding means to a paper receiving section of an image forming apparatus arranged on an upper side of the multistage paper feeding/conveying apparatus;

said paper feeding means having a single paper feeding unit which can selectively come in contact with a front end portion of an uppermost sheet of recording paper on an upper face thereof with respect to sheets of recording paper stored within said plurality of recording paper storing means;

the paper feeding unit and said vertical conveying means having a single endless conveying belt which is wound around a group of rollers disposed in the paper feeding unit and a group of rollers disposed in an apparatus frame and is moved through a paper feeding section and the paper receiving section of said image forming apparatus; and the paper feeding unit and said vertical conveying means further having means for forming an electric charge pattern for adsorbing the sheet of recording paper to the endless conveying belt.

2. A multistage paper feeding/conveying apparatus as claimed in claim 1, wherein said endless conveying belt passing through said paper feeding unit is located in a position in which no endless conveying belt is interfered with the recording paper storing means when the endless conveying belt is raised and lowered between the respective recording paper storing means; and the endless conveying belt is horizontally inserted onto a contact region of the recording paper storing means for feeding the sheet of recording paper on the sheet of recording paper in a front end portion thereof.

3. A multistage paper feeding/conveying apparatus as claimed in claim 2, wherein lowermost one of said plurality of recording paper storing means is projected forward in a paper feeding side end portion thereof in comparison with the remaining upper recording paper storing means; and a horizontal inserting amount of the endless conveying belt within said paper feeding unit onto the contact region in the front end portion of the sheet of recording paper with respect to the lowermost recording paper storing means is smaller than that in the remaining upper recording paper storing means.

4. A multistage paper feeding/conveying apparatus as claimed in claim 2, wherein the multistage paper feeding/conveying apparatus further comprises means for changing a relative speed of the endless conveying belt passing through said paper feeding unit with respect to the sheet of recording paper in the contact region thereon between a driving speed of the endless conveying belt and an approximately zero speed.

5. A multistage paper feeding/conveying apparatus as claimed in claim 1, wherein a driving or conveying speed of said endless conveying belt is higher than a reference conveying speed of the sheet of recording paper within said image forming apparatus; and means for partially changing the conveying speed is disposed in one of the multistage paper feeding/conveying apparatus and the image forming apparatus such that the driving speed and the reference conveying speed are in conformity with each other in the receiving section of the sheet of recording paper between the multistage paper feeding/conveying apparatus and said image forming apparatus.

6. A multistage paper feeding/conveying apparatus as claimed in claim 1, wherein an adsorbing strength of the sheet of recording paper with respect to the electric charge pattern formed on said endless conveying belt can be changed and controlled in accordance with a thickness of the fed and conveyed sheet of recording paper such that the adsorbing strength is increased as the thickness of the paper sheet is increased.

7. A method for feeding a sheet recording paper, comprising the steps of:

horizontally inserting a portion of an endless conveying belt into a space situated above an upper face of a bundle of sheets of recording paper stored in a specified feeding tray of a plurality of feeding trays which are arranged in a multi-stage manner to thereby form a contact region of said endless conveying belt to contact with a front end portion of an uppermost sheet of recording paper;

forming an electric charge pattern in an adsorption region of said endless conveying belt to adsorb the sheet of recording paper within said specified feeding tray;

changing a relative speed of said contact region with respect to the sheet of recording paper such that said relative speed is approximately equal to zero by winding back a portion of said endless conveying belt wound up before-hand;

lowering said contact region which has reached an approximately zero speed to make said contact region come into contact with an upper face of the sheet of recording paper so that the sheet of recording paper is adsorbed to said contact region;

raising said contact region which has adsorbed the sheet of recording paper up to a predetermined position; and returning a speed of said contact region to a predetermined conveying speed of said endless conveying belt by partially winding up said endless conveying belt, and conveying the adsorbed sheet of recording paper.

8. A method for feeding a sheet of recording paper, comprising the steps of:

horizontally inserting a portion of an endless conveying belt into a space situated above an upper face of a bundle of sheets of recording paper stored in a specified feeding tray of a plurality of feeding trays which are arranged in a multi-stage manner to thereby form a contact region of said endless conveying belt to contact with a region of an uppermost sheet of recording paper, said region extending behind a position located slightly backward from a front end of said uppermost sheet of recording paper;

forming an electric charge pattern in an adsorption region of said endless conveying belt to adsorb the sheet of recording paper within said specified feeding tray;

changing a relative speed of said contact region with respect to the sheet of recording paper such that said relative speed is approximately equal to zero by partially winding back a portion of said endless conveying belt wound up before-hand;

lowering said contact region which has reached an approximately zero speed to make said contact region come into contact with an upper face of the sheet of recording paper so that the sheet of recording paper is adsorbed to said contact region;

raising said contact region which has adsorbed the sheet of recording paper up to a predetermined position, while changing a relative speed of said contact region with respect to said specified feeding tray to a minus speed by winding back a remaining wound-up portion of said endless conveying belt so as to move said adsorbed sheet of recording paper toward an inward portion of said feeding tray; and returning a speed of said contact region to a predetermined conveying speed of said endless conveying belt by partially winding up said endless conveying belt, and conveying the adsorbed sheet of recording paper.

9. A method for feeding a sheet of recording paper, comprising a first feeding pattern and a second feeding pattern, said first feeding pattern being performed when a specified feeding tray is selected from among a plurality of feeding trays arranged in a multi-stage manner, said second feeding pattern being performed when one of remaining feeding trays other than said specified feeding tray is selected, said first feeding pattern comprising the steps of:

horizontally inserting a portion of an endless conveying belt into a space situated above an upper face of a bundle of sheets of recording paper stored in said specified feeding tray to thereby form a contact region of said endless conveying belt to contact with a region of an uppermost sheet of recording paper, said region extending behind a position located slightly backward from a front end of said uppermost sheet of recording paper;

forming an electric charge pattern in an adsorption region of said endless conveying belt to adsorb the sheet of recording paper within said specified feeding tray;

changing a relative speed of said contact region with respect to the sheet of recording paper such that said relative speed is approximately equal to zero by partially winding back a portion of said endless conveying belt wound up beforehand;

lowering said contact region which has reached an approximately zero speed to make said contact region come into contact with an upper face of the sheet of recording paper so that the sheet of recording paper is adsorbed to said contact region;

raising said contact region which has adsorbed the sheet of recording paper up to a predetermined position, while changing a relative speed of said contact region with respect to said specified feeding tray to a minus speed by winding back a remaining wound-up portion of said endless conveying belt so as to move said adsorbed sheet of recording paper toward an inward portion of said feeding tray; and returning a speed of said contact region to a predetermined conveying speed of said endless conveying belt by partially winding up said endless conveying belt, and conveying the adsorbed sheet of recording paper, said second feeding pattern comprising the steps of:

horizontally inserting the portion of said endless conveying belt into a space situated above an upper face of a bundle of sheets of recording paper stored in said one of the remaining feeding trays to thereby form a contact region of said endless conveying belt to contact with a front portion of an uppermost sheet of recording paper;

forming an electric charge pattern in an adsorption region of said endless conveying belt to adsorb the sheet of recording paper within said one of the remaining feeding trays;

changing a relative speed of said contact region with respect to the sheet of recording paper such that said relative speed is approximately equal to zero by winding back a portion of said endless conveying belt wound up beforehand;

lowering said contact region which has reached an approximately zero speed to make said contact region come into contact with an upper face of the sheet of recording paper so that the sheet of recording paper is adsorbed to said contact region;

raising said contact region which has adsorbed the sheet of recording up to a predetermined position; and returning a speed of said contact region to a predetermined conveying speed of said endless conveying belt by partially winding up said endless conveying belt, and conveying the adsorbed sheet of recording paper.

* * * * *